US011653784B2

(12) United States Patent
Mullet et al.

(10) Patent No.: US 11,653,784 B2
(45) Date of Patent: May 23, 2023

(54) DRAPERY BLADED DRIVE COUPLER

(71) Applicant: Current Products Corp., Pensacola, FL (US)

(72) Inventors: Willis J. Mullet, Gulf Breeze, FL (US); Scott Hand, Pace, FL (US); Jon Smidt, Crestview, FL (US)

(73) Assignee: Current Products Corp., Pensacola, FL (US)

( * ) Notice: Subject to any disclaimer, the term of this patent is extended or adjusted under 35 U.S.C. 154(b) by 229 days.

(21) Appl. No.: 16/562,009

(22) Filed: Sep. 5, 2019

(65) Prior Publication Data

US 2020/0077829 A1 Mar. 12, 2020

Related U.S. Application Data

(60) Provisional application No. 62/727,918, filed on Sep. 6, 2018.

(51) Int. Cl.

| | |
|---|---|
| ***A47H 5/06*** | (2006.01) |
| ***A47H 1/02*** | (2006.01) |
| *A47H 5/02* | (2006.01) |

(52) U.S. Cl.

CPC ..... *A47H 5/06* (2013.01); *A47H 1/02* (2013.01); *A47H 2001/0215* (2013.01); *A47H 2005/025* (2013.01)

(58) Field of Classification Search

CPC .... A47H 5/06; A47H 1/02; A47H 2001/0215; A47H 2005/025; A47H 13/02; E06B 9/72

See application file for complete search history.

(56) References Cited

U.S. PATENT DOCUMENTS

| | | | | |
|---|---|---|---|---|
| 3,724,524 | A * | 4/1973 | Potter | G03B 21/58 160/24 |
| 4,159,162 | A * | 6/1979 | Christoffel | G03B 21/58 160/310 |
| 9,095,908 | B2 * | 8/2015 | Mullet | B23B 5/08 |
| 2010/0279779 | A1 * | 11/2010 | Anthoine | F16D 1/101 464/71 |
| 2014/0076505 | A1 * | 3/2014 | Mullet | E06B 9/40 160/121.1 |
| 2018/0171710 | A1 * | 6/2018 | Kirby | E06B 9/72 |

FOREIGN PATENT DOCUMENTS

DE 3842865 A * 7/1989

* cited by examiner

*Primary Examiner* — Johnnie A. Shablack
*Assistant Examiner* — John W Hanes, Jr.
(74) *Attorney, Agent, or Firm* — Brownwinick Law Firm; Christopher A. Proskey

(57) ABSTRACT

Disclosed are various examples of drapery systems one of which includes a drapery rod operatively connected to a structure by a first bracket and a second bracket. In one nonlimiting embodiment the drapery rod has an exterior surface with a guide structure and a hollow interior having a feature. At least one example drapery system includes a drive coupler and a motor operatively coupled to the drive coupler, wherein the drive coupler is configured to be inserted within the hollow interior of the drapery rod and the drive coupler is configured to engage the feature of the drapery rod, wherein when the motor operates the drive coupler rotates, and rotation of the drive coupler causes rotation of the drapery rod.

31 Claims, 29 Drawing Sheets

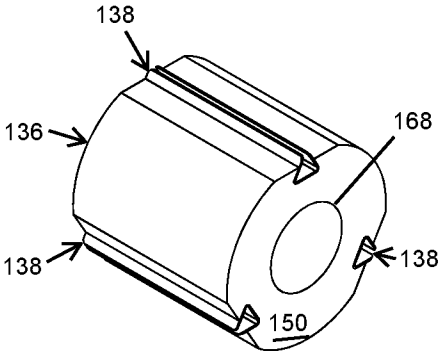
FIG. 12A
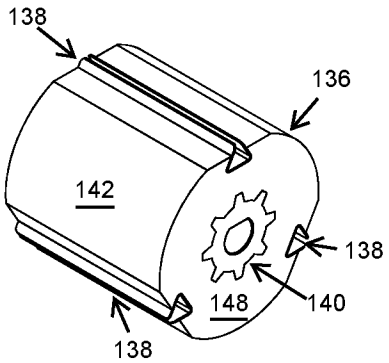
FIG. 12B
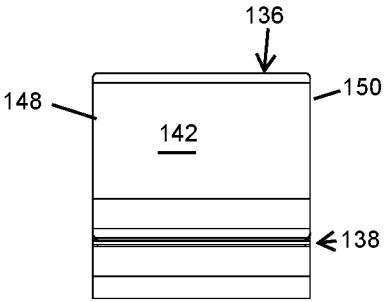
FIG. 12D
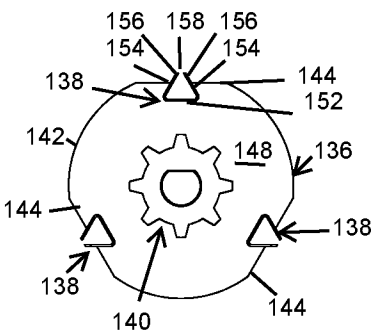
FIG. 12C
FIG. 12E

10

DRAPERY BLADED DRIVE COUPLER

CROSS-REFERENCE TO RELATED APPLICATIONS

This application claims the benefit of U.S. Provisional Patent Application No. 67/727,918 which was filed with the United States Patent and Trademark Office on Sep. 6, 2018, the entire contents of which is herein incorporated by reference.

FIELD OF THE DISCLOSURE

This disclosure relates to window coverings. More specifically and without limitation, this disclosure relates to a rotating drapery rod system.

BACKGROUND OF THE DISCLOSURE

Architectural coverings, such as curtains, shades, draperies and the like are old and well known in the art and are frequently used to provide privacy and to limit the amount of light that is permitted to pass through a window and into a room or building. There are countless types, forms and designs of architectural coverings known in the art. The term architectural covering is used to describe any and all of these types, forms and designs including blinds, shades, draperies, and the like.

One form of architectural covering of particular interest in this application is commonly referred to as draperies. Common components of draperies include a support rod connected to brackets positioned above or adjacent to a window or door. In one arrangement of a drapery, the support rod rotates and drives the shade material across the length of the support rod. This arrangement is more fully described in Applicant's related U.S. Pat. No. 9,095,908 entitled Rotatable Drapery rod For Moving A Window Covering, issued on Aug. 4, 2015 which is fully incorporated herein, including related applications; and Applicant's related patent application Ser. No. 14/786,877 filed on Oct. 23, 2015 entitled Motorized Drapery Apparatus, System and Method of Use which is also fully incorporated by reference herein, including any related applications.

In these related patent applications, a motorized drapery apparatus is presented having a plurality if rings positioned around or looped over the support rod (also referred to as the rotatable drapery rod). Shade material is attached to these rings by way of pins or hooks or any other arrangement.

While this arrangement is elegant and effective, problems and challenges remain with the present designs and offerings.

Thus it is a primary object of the disclosure to provide a drapery rod system that improves upon the state of the art.

Another object of the disclosure is to provide a drapery rod system that reduces cost over existing arrangements.

Yet another object of the disclosure is to provide a drapery rod system that facilitates the use of thin walled tubes.

Another object of the disclosure is to provide a drapery rod system that allows for the use of formed tubes, instead of machined tubes.

Yet another object of the disclosure is to provide a drapery rod system that facilitates connection to formed tubes.

Another object of the disclosure is to provide a drapery rod system that facilitates use of less expensive components.

Yet another object of the disclosure is to provide a drapery rod system that reduces the complexity of the manufacturing process.

Another object of the disclosure is to provide a drapery rod system that reduces the amount of time required to manufacture.

Yet another object of the disclosure is to provide a drapery rod system that reduces the amount of machine time required to manufacture the product.

Another object of the disclosure is to provide a drapery rod system that eliminates the need for a machined tube.

Yet another object of the disclosure is to provide a drapery rod system that is easy to assemble.

Another object of the disclosure is to provide a drapery rod system that has a relatively foolproof design.

Yet another object of the disclosure is to provide a drapery rod system that reduces the transmission of vibrations.

Another object of the disclosure is to provide a drapery rod system that dampens vibrations.

Yet another object of the disclosure is to provide a drapery rod system that provides some give to the system.

Another object of the disclosure is to provide a drapery rod system that is easy to use. Yet another object of the disclosure is to provide a drapery rod system that is simple in design.

Another object of the disclosure is to provide a drapery rod system that facilitates quiet operation.

Yet another object of the disclosure is to provide a drapery rod system that facilitates smooth operation.

Another object of the disclosure is to provide a drapery rod system that is relatively inexpensive or affordable.

Yet another object of the disclosure is to provide a drapery rod system that has a minimum number of parts.

Another object of the disclosure is to provide a drapery rod system that can be used with any shade material.

Yet another object of the disclosure is to provide a drapery rod system that facilitates robust operation.

These and other objects, features, or advantages of the present disclosure will become apparent from the specification, claims and drawings.

SUMMARY OF THE DISCLOSURE

A drapery system is presented having a drapery rod extending the length from a first end to a second end. The drapery rod is connected to a structure by a pair of brackets. The drapery rod has a cylindrical shape with an exterior surface. The exterior surface of the drapery rod has a guide structure, which in one arrangement is a plurality of helical grooves. A plurality of rings are positioned around the drapery rod that are used to connect shade material to the drapery rod. In the arrangement presented these rings include a partial driver ring, a full driver ring and a plurality of idler rings. The drapery rod is formed of a thin walled formed tube having a seam and a hollow interior. A motor is connected to a drive coupler having a main body and a plurality of connection members. The main body is formed of a compressible non-metallic material that is configured to absorb vibrations and reduce noise. The connection members are formed of a metallic material and are formed of generally triangular shaped members with a pair of arms that angle toward one another and terminate in opposing ends with a space between the opposing ends that is configured to engage and hold onto the seam of the drapery rod. When the drive coupler is inserted into the hollow interior of the drapery rod and the motor is activated, the drive coupler rotates inside the hollow interior of the drapery rod until a connection member engages the seam and captures the seam in the space between the opposing arms. Once the seam is captured by a connection member, the drapery rod rotates with the drive coupler when the motor is activated.

BRIEF DESCRIPTION OF THE DRAWINGS

FIG. 12A is a perspective view of the inward end of main body of a drive coupler of the rotating drapery rod system shown in FIGS. 1-11;

FIG. 12B is a perspective view of the outward end of main body of a drive coupler of the rotating drapery rod system shown in FIGS. 1-11;

FIG. 12C is an elevation view of the inward end of main body of a drive coupler of the rotating drapery rod system shown in FIGS. 1-11;

FIG. 12D is an elevation view of the side of main body of a drive coupler of the rotating drapery rod system shown in FIGS. 1-11;

FIG. 12E is an elevation view of the outward end of main body of a drive coupler of the rotating drapery rod system shown in FIGS. 1-11;

DETAILED DESCRIPTION OF THE DISCLOSURE

Figure 1:
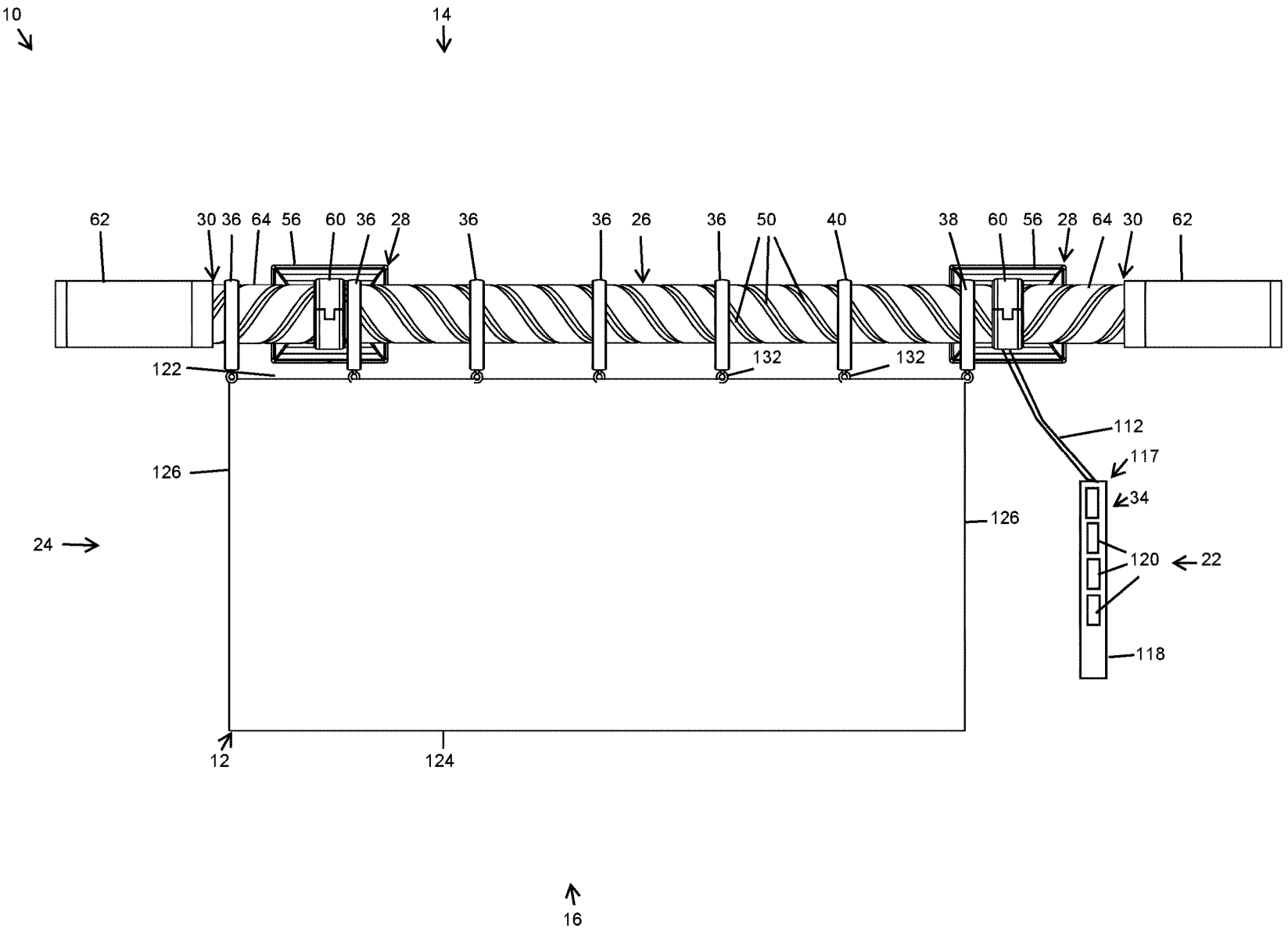
FIG. 1 is a front elevation view of a rotating drapery rod system utilizing a thin walled formed tube as the drapery rod and a bladed coupler to connect to and drive the rotating drapery rod from the hollow interior of the drapery rod.
Figure 2:
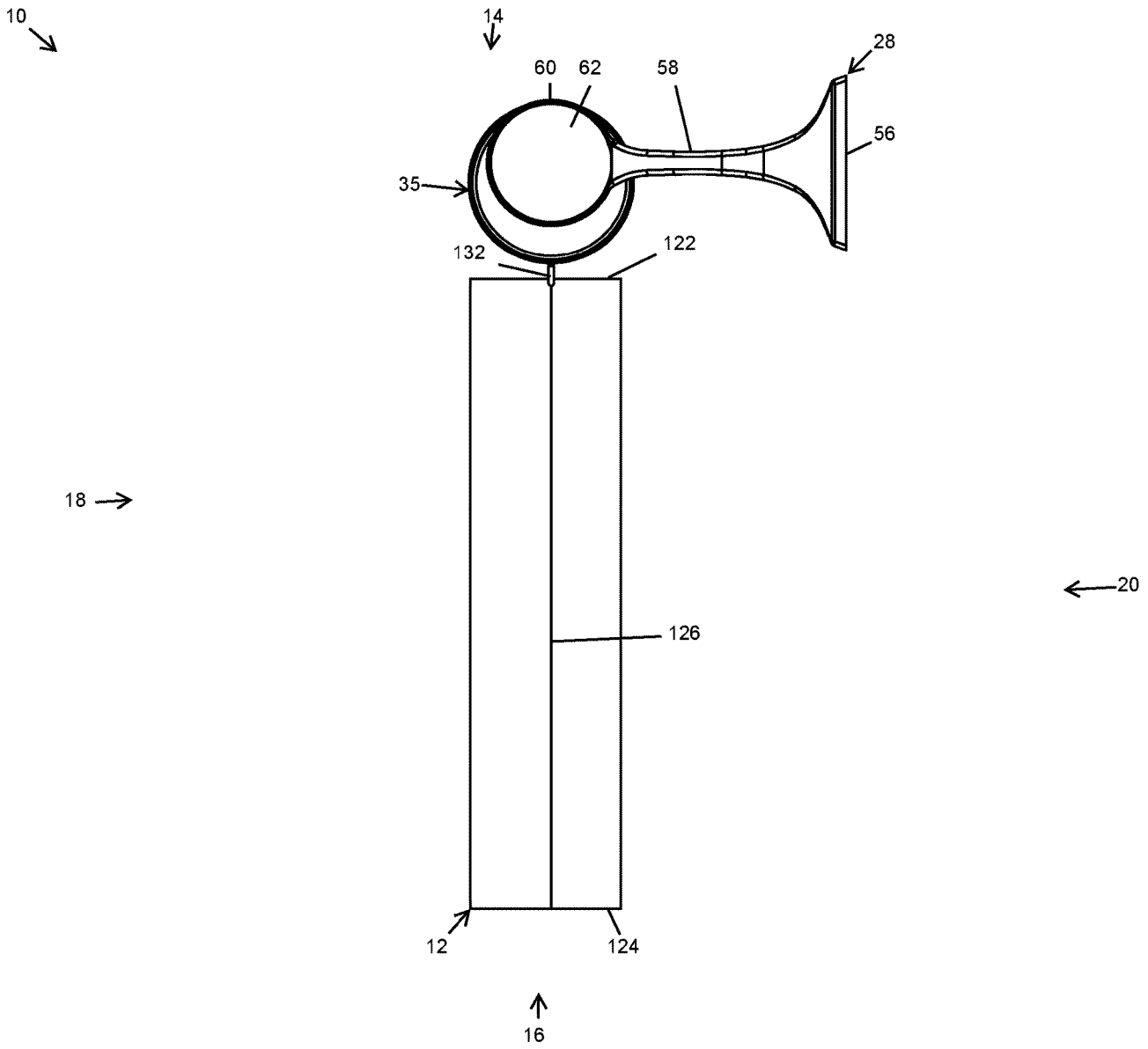
FIG. 2 is a side elevation view of the rotating drapery rod system shown in FIG. 1.
Figure 3:
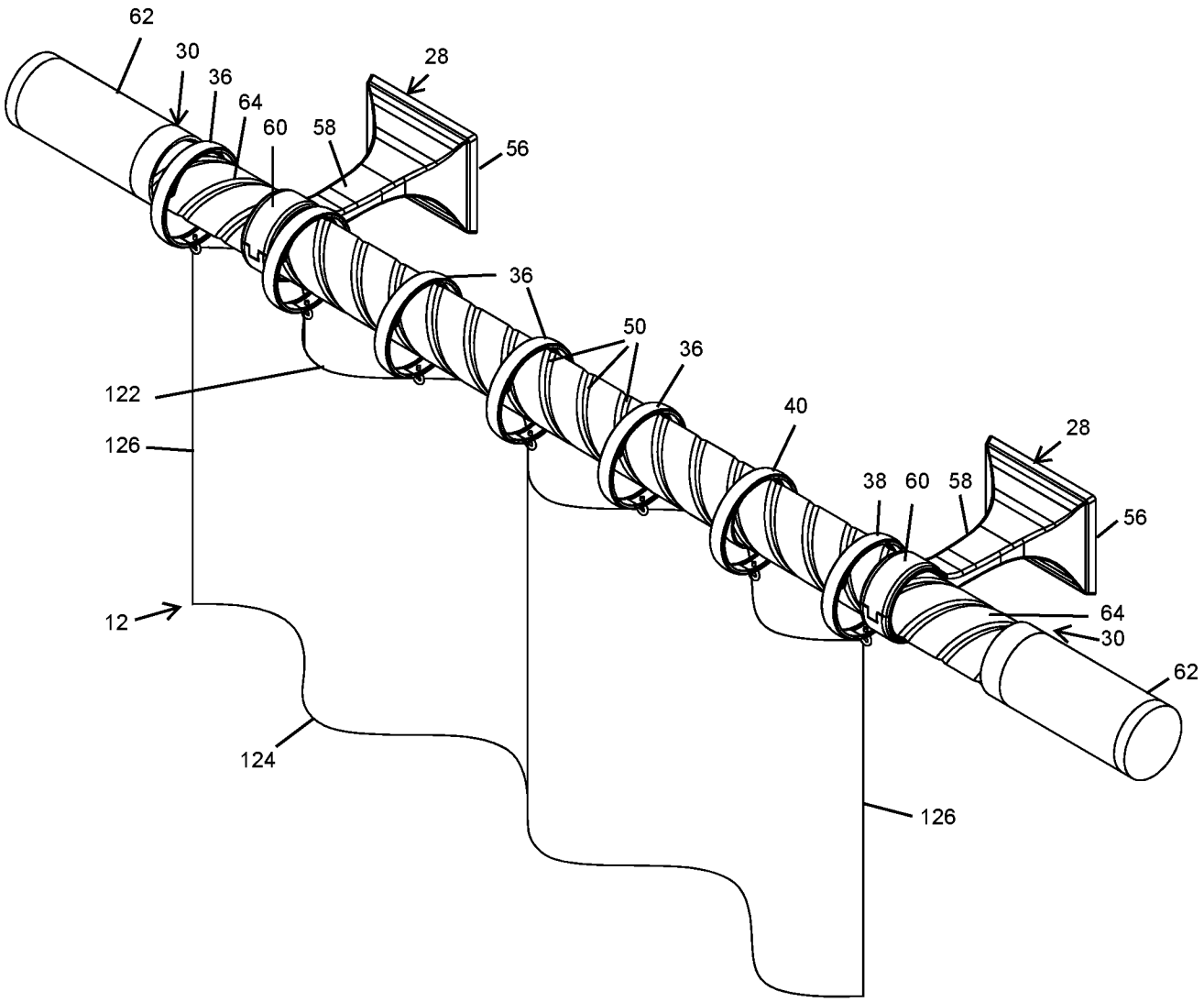
FIG. 3 is a perspective front view of the rotating drapery rod system shown in FIGS. 1 and 2.
Figure 4:
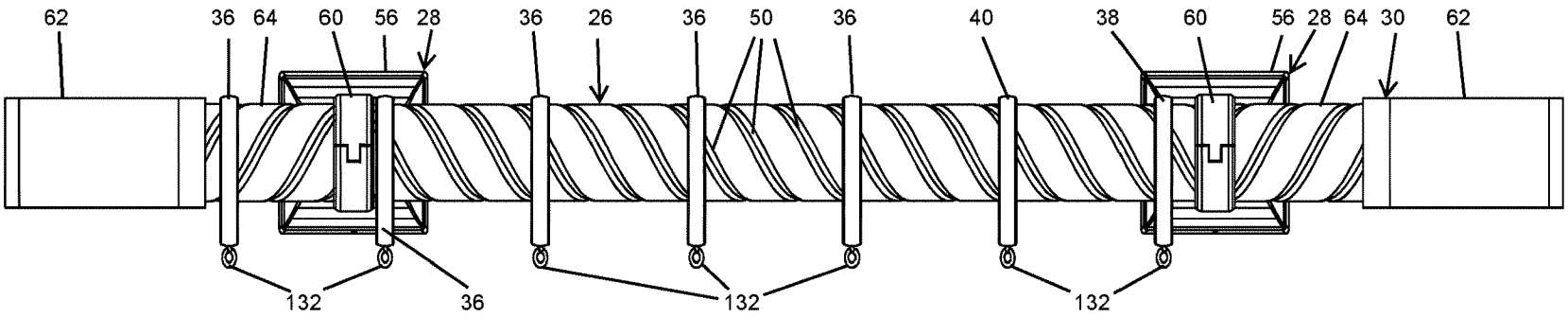
FIG. 4 is a front elevation view of the rotating drapery rod system shown in FIGS. 1-3, the view showing the shade material removed from the rings.
Figure 5:
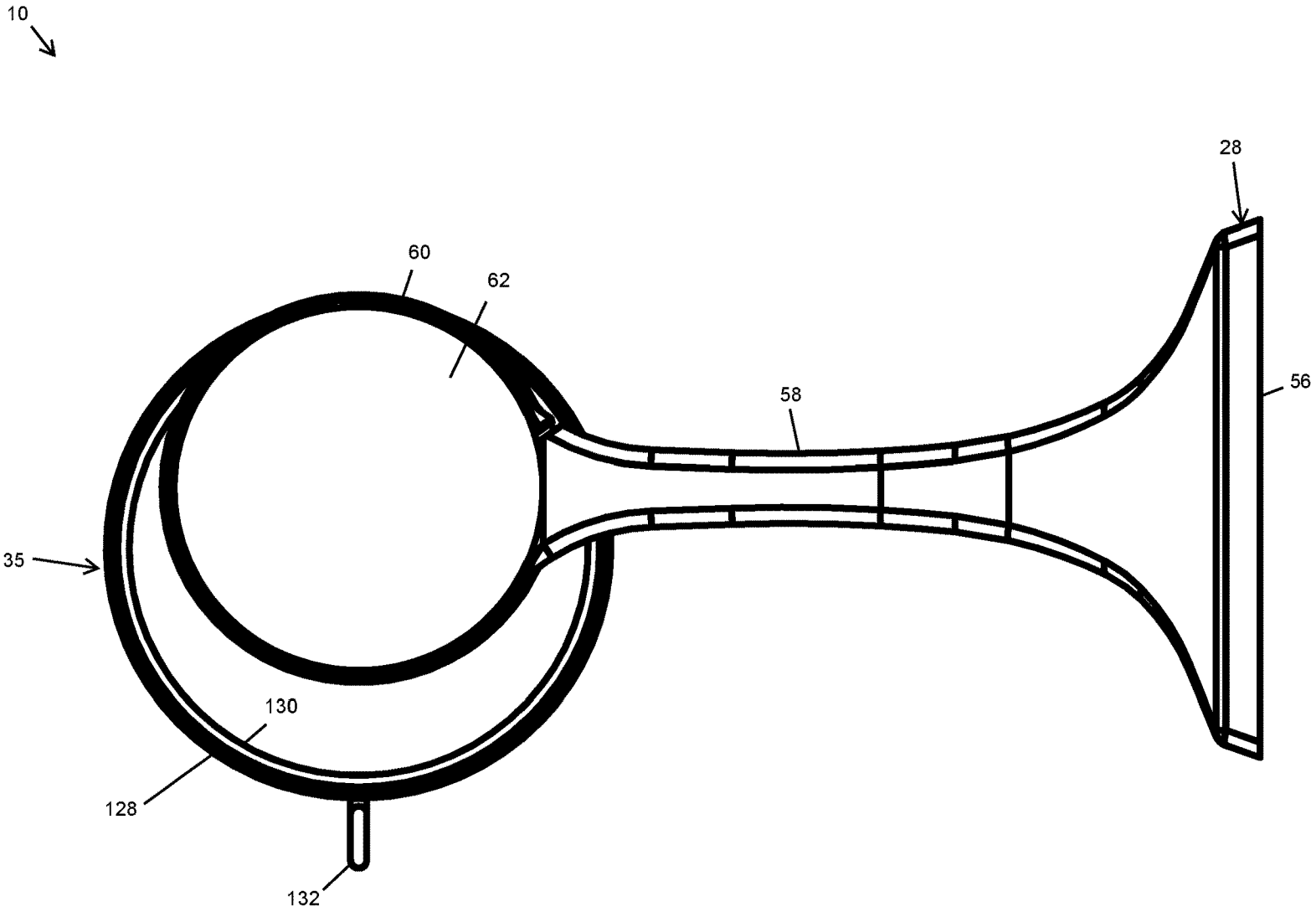
FIG. 5 is a side elevation view of the rotating drapery rod system shown in FIG. 4.
Figure 6:
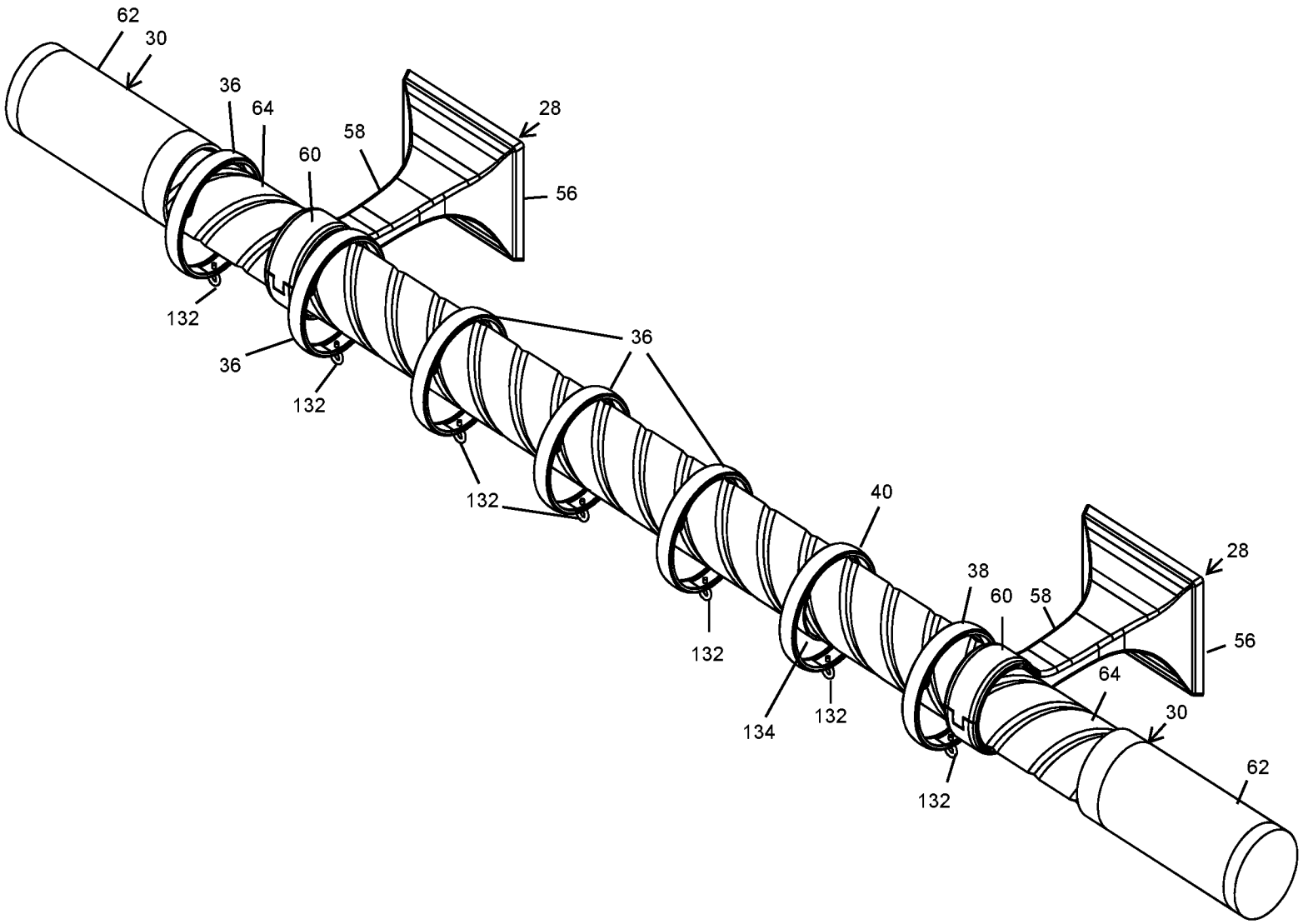
FIG. 6 is a perspective front view of the rotating drapery rod system shown in FIGS. 4 and 5.
Figure 7:
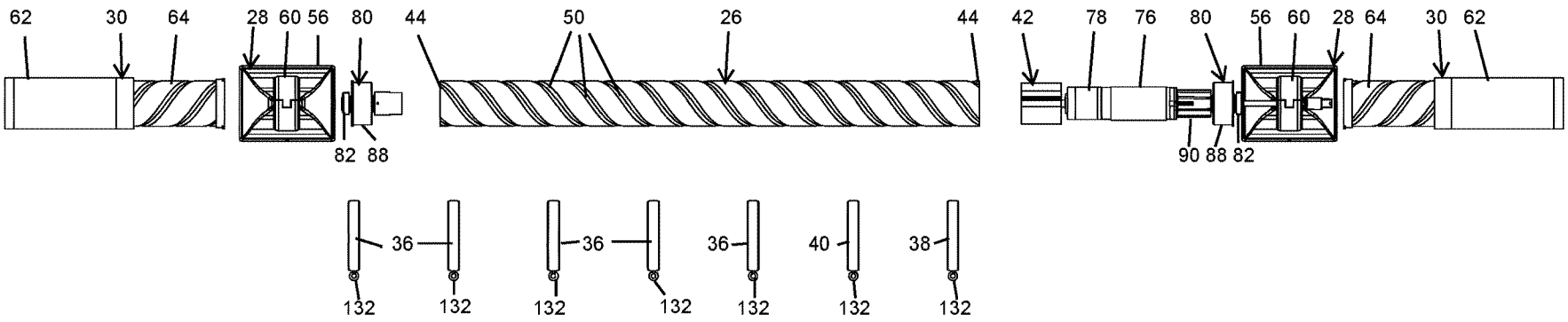
FIG. 7 is a front elevation exploded view of the rotating drapery rod system shown in FIGS. 4-6.
Figure 8:
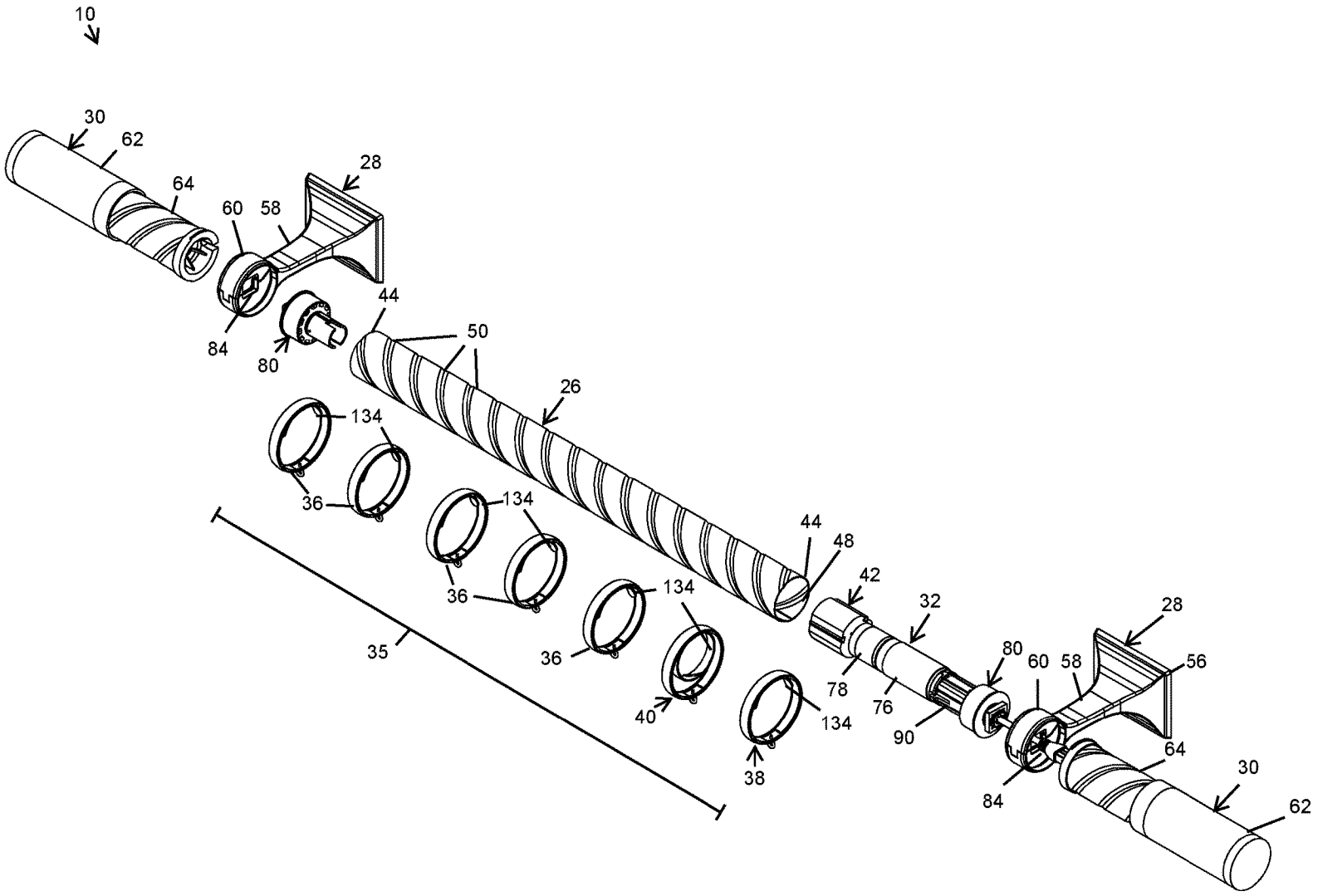
FIG. 8 is a side perspective front view of the rotating drapery rod system shown in FIGS. 4-7.
Figure 9:
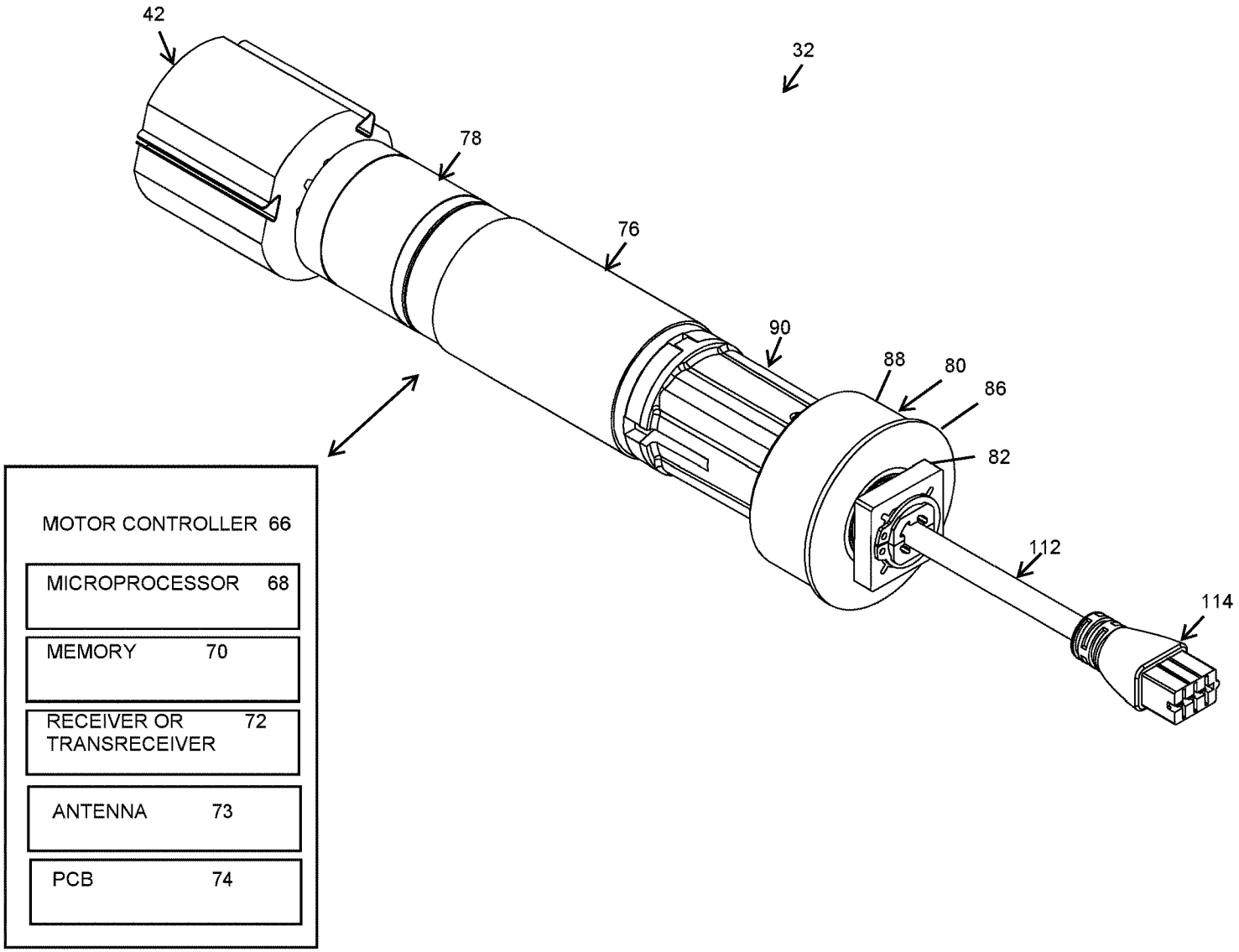
FIG. 9 is a perspective view of a motor control assembly of the rotating drapery rod system shown in FIGS. 1-8.
Figure 10:
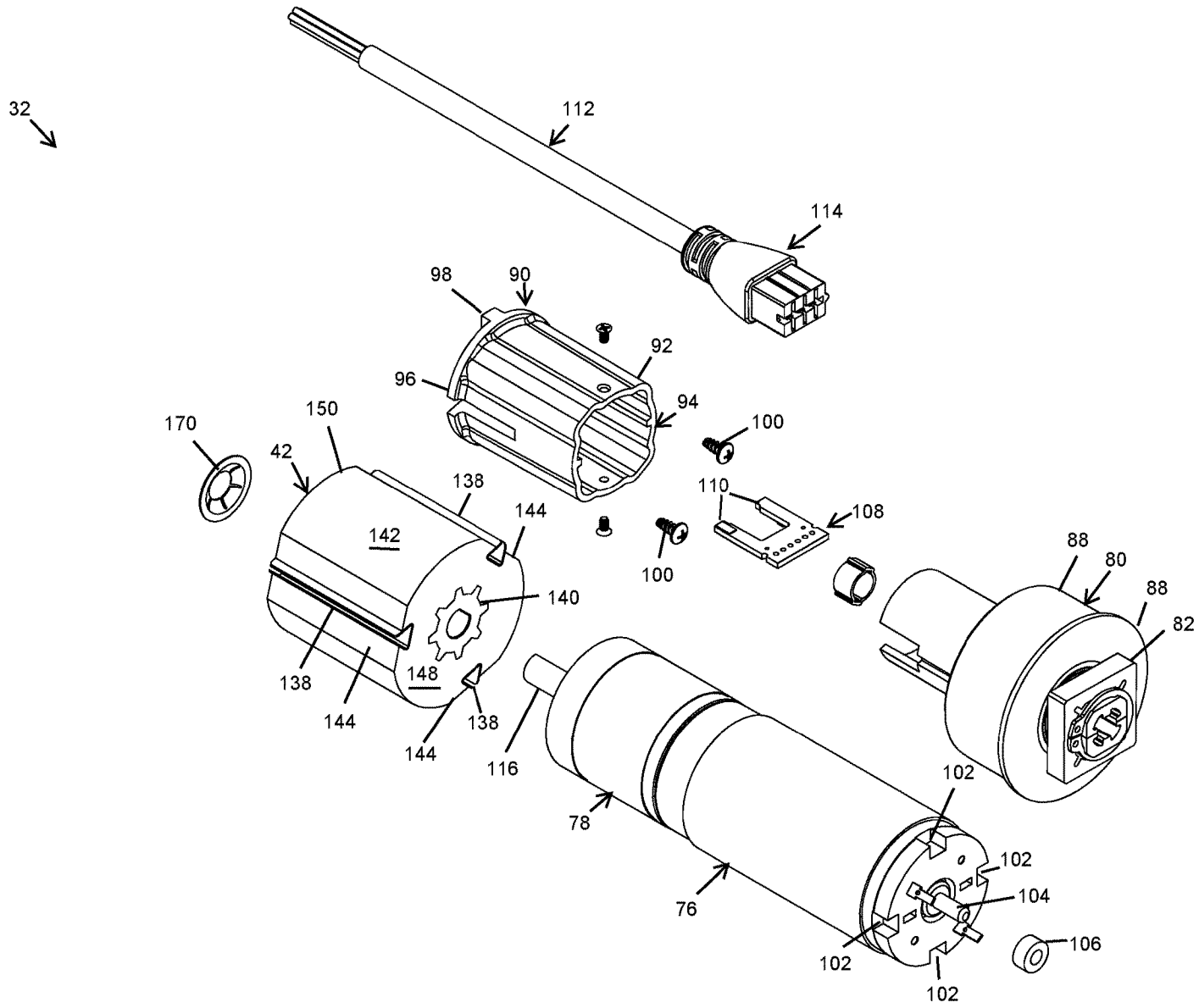
FIG. 10 is an exploded perspective view of a motor control assembly of the rotating drapery rod system shown in FIG. 9.
Figure 11:
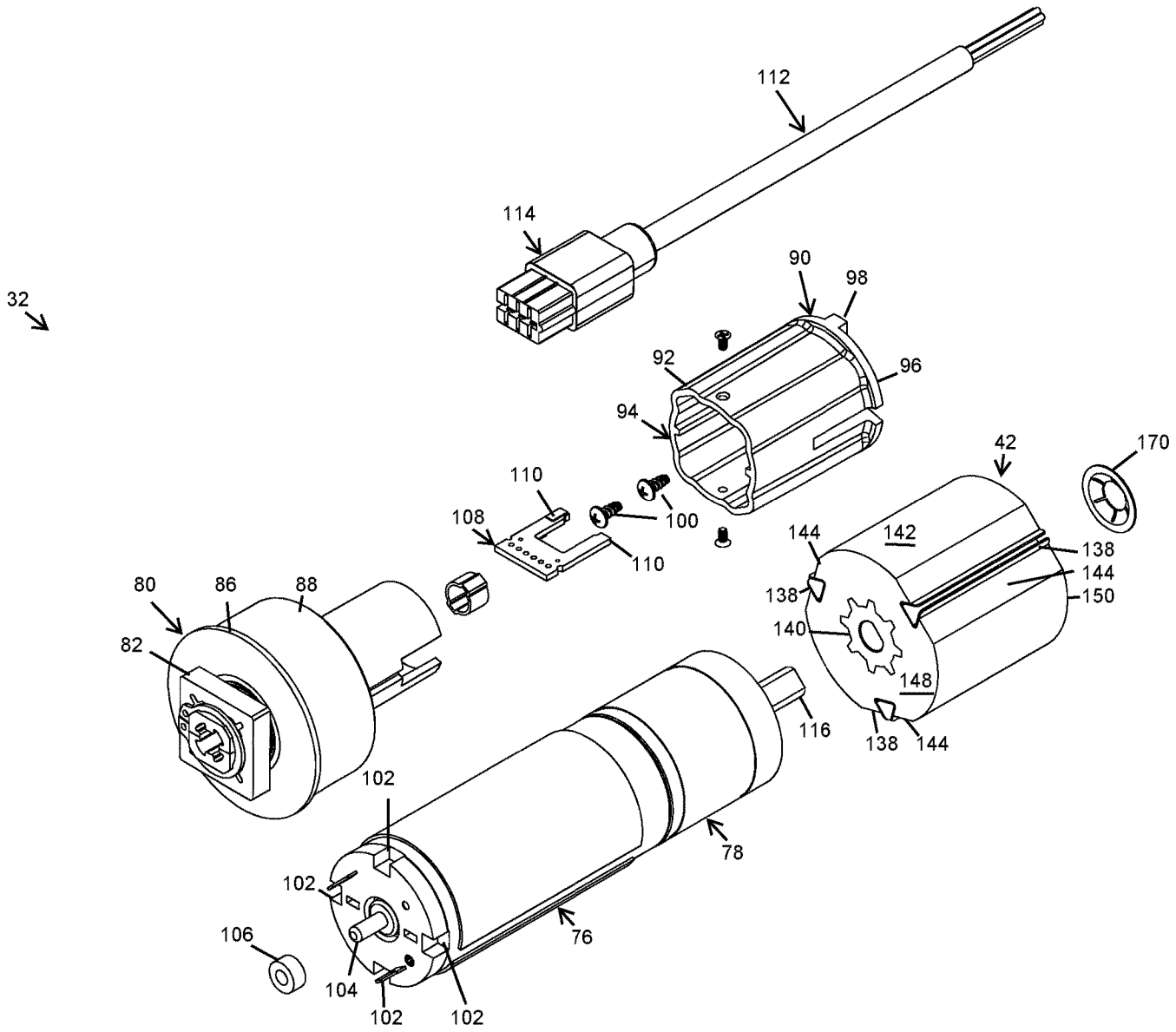
FIG. 11 is another exploded perspective view of a motor control assembly of the rotating drapery rod system shown in FIG. 9.
Figure 13:
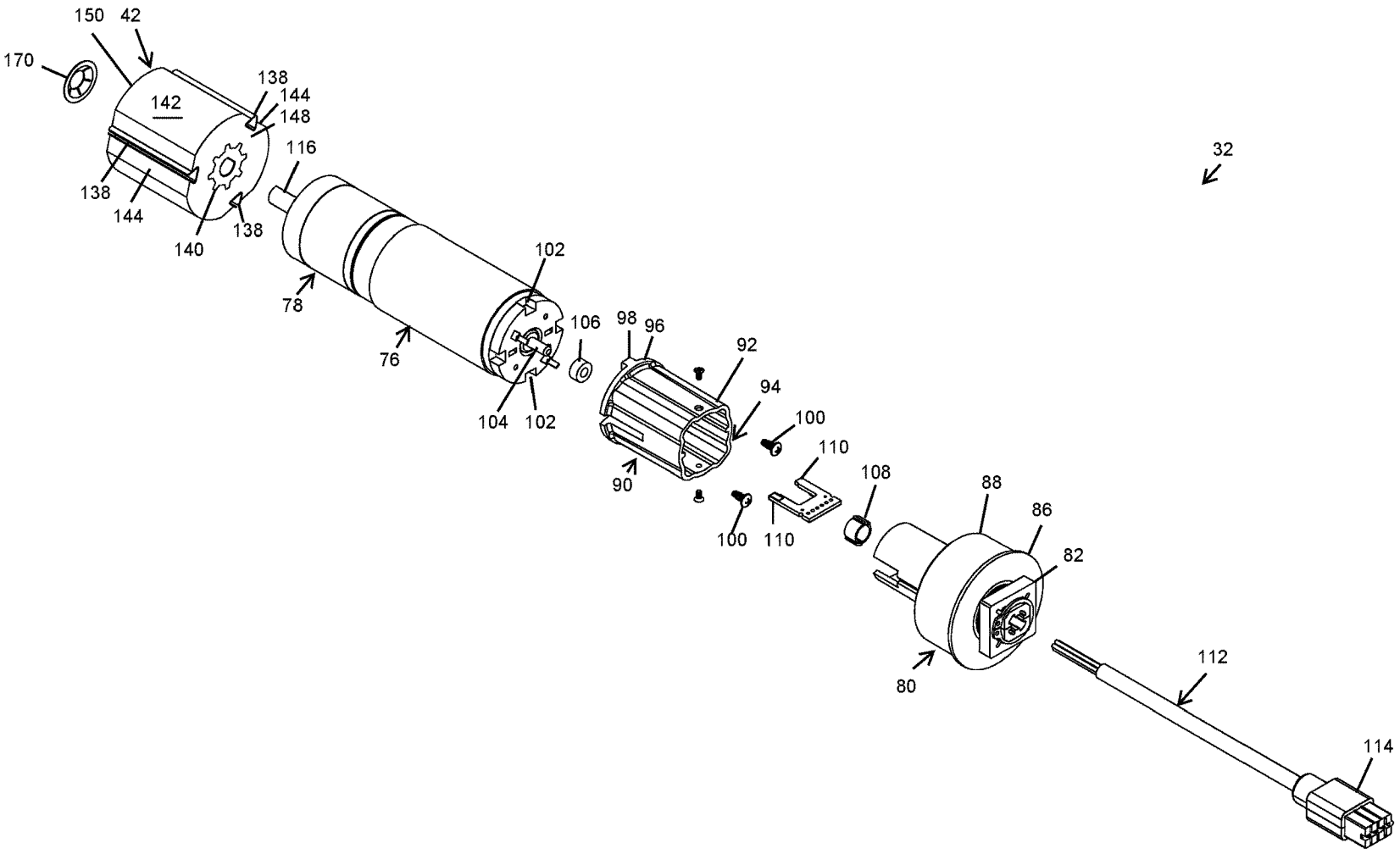
FIG. 13 is another exploded perspective view of a motor control assembly of the rotating drapery rod system shown in FIG. 9.
Figure 14:
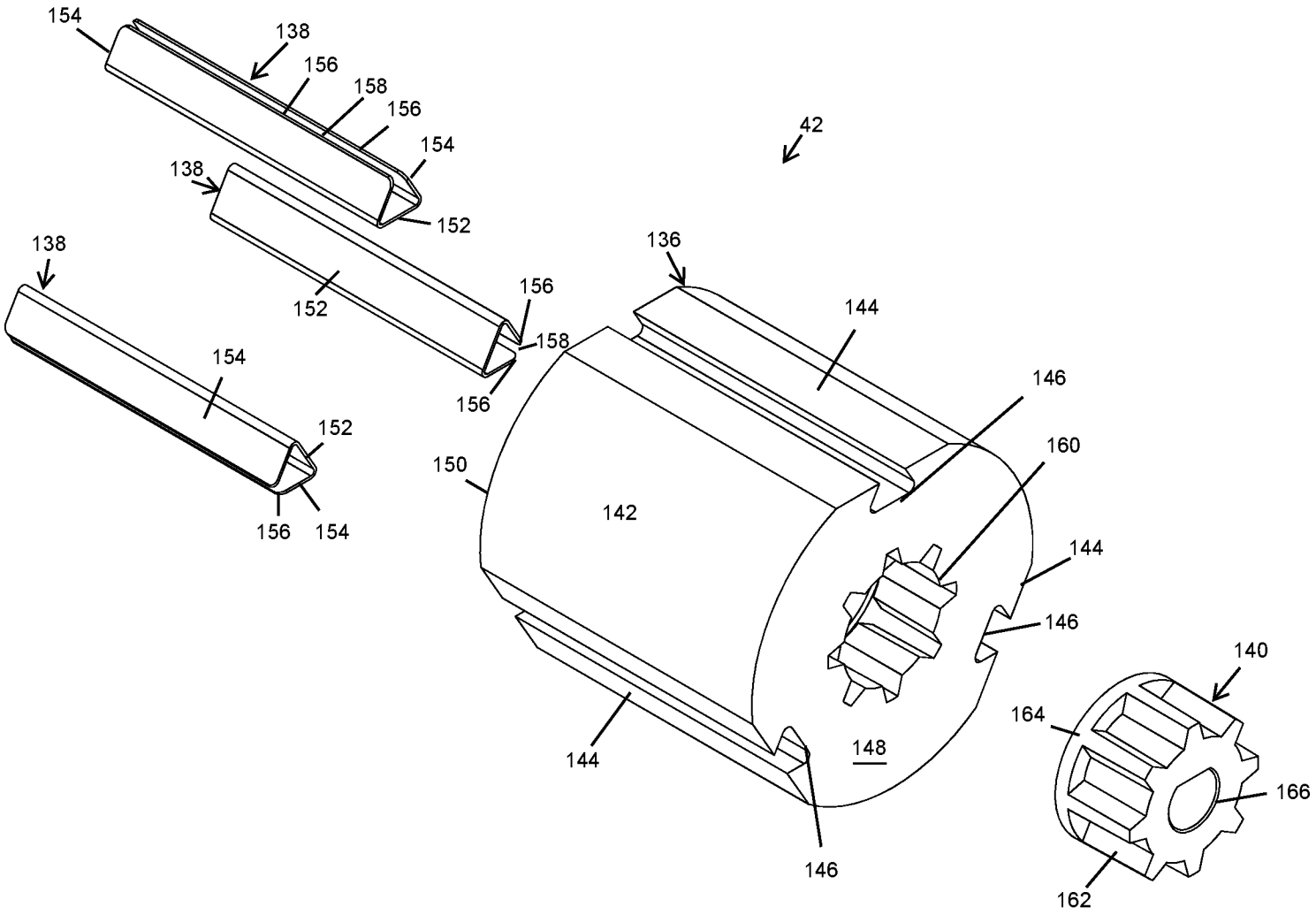
FIG. 14 is an exploded perspective view of the outward end of main body of a drive coupler of the rotating drapery rod system shown in FIGS. 1-13

In the following detailed description, reference is made to the accompanying drawings which form a part hereof, and in which is shown by way of illustration specific embodiments in which the disclosure may be practiced. These embodiments are described in sufficient detail to enable those skilled in the art to practice the disclosure, and it is to be understood that other embodiments may be utilized and that mechanical, procedural, and other changes may be made without departing from the spirit and scope of the disclosure. The following detailed description is, therefore, not to be taken in a limiting sense, and the scope of the disclosure is defined only by the appended claims, along with the full scope of equivalents to which such claims are entitled.

As used herein, the terminology such as vertical, horizontal, top, bottom, front, back, end, sides, left, right, and the like are referenced according to the views, pieces, parts, components and figures presented. It should be understood, however, that the terms are used only for purposes of description, and are not intended to be used as limitations. Accordingly, orientation of an object or a combination of objects may change without departing from the scope of the disclosure.

System:

With reference to the figures, a drapery rod system 10 (system 10) is presented. System 10 is formed of any suitable size, shape and design and is configured to facilitate the opening and closing of shade material 12 in a quick, easy, safe, quiet and smooth manner. In the arrangement shown, as one example, the drapery rod system 10 has a top side 14, a bottom side 16, a front side 18, a back side 20, a left side 22 and a right side 24. In the arrangement shown, as one example, the drapery rod system 10 includes the following component pieces, among others: drapery rod 26, brackets 28, finials 30, motor control assembly 32, power source 34, rings 35 including one or more idler rings 36, partial driver rings 38, full driver rings 40, drive coupler 42, and shade material 12, among other components.

Drapery Rod:

Drapery rod system 10 includes a drapery rod 26. Drapery rod 26 is formed of any suitable size, shape and design and is configured to support as well as open and close shade material 12. In the arrangement shown, as one example, drapery rod 26, is formed of an elongated member that extends a length between ends 44. Drapery rod 26 may be formed of a single, unitary member or may be formed of a plurality of connected members that form a drapery rod 26.

In the arrangement shown, as one example, when viewed from an end 44 drapery rod 12 has a generally cylindrical shape with an exterior surface 46 and a hollow interior 48. In the arrangement shown, as one example, exterior surface 46 is generally cylindrical in shape and has a smooth surface that includes guide structure 50.

Guide structure 50 is formed of any suitable size, shape and design and is configured to facilitate the movement of idler rings 36, partial driver rings 38 and full driver rings 40 along the length of the drapery rod 26 from end 44 to end 44. In one arrangement, as is shown, guide structure 50 is formed of a helical guide structure positioned in exterior surface 46. The helical guide structure can be a left-hand guide structure, a right-hand guide structure, or both, or a plurality or combination of left-hand guide structures and/or right-hand guide structures. Guide structure 50 can either be grooves, indentations, protrusions, threads or any other feature or the like, as is described herein. Guide structure 50 can either ground or machined into the surface of drapery rod 26, knurled into the surface of drapery rod 26, cast into the surface of drapery rod 26, formed into the surface of drapery rod 26, extruded into the exterior surface of drapery rod 26, or created by any other means or methods known in the art.

Figure 15:
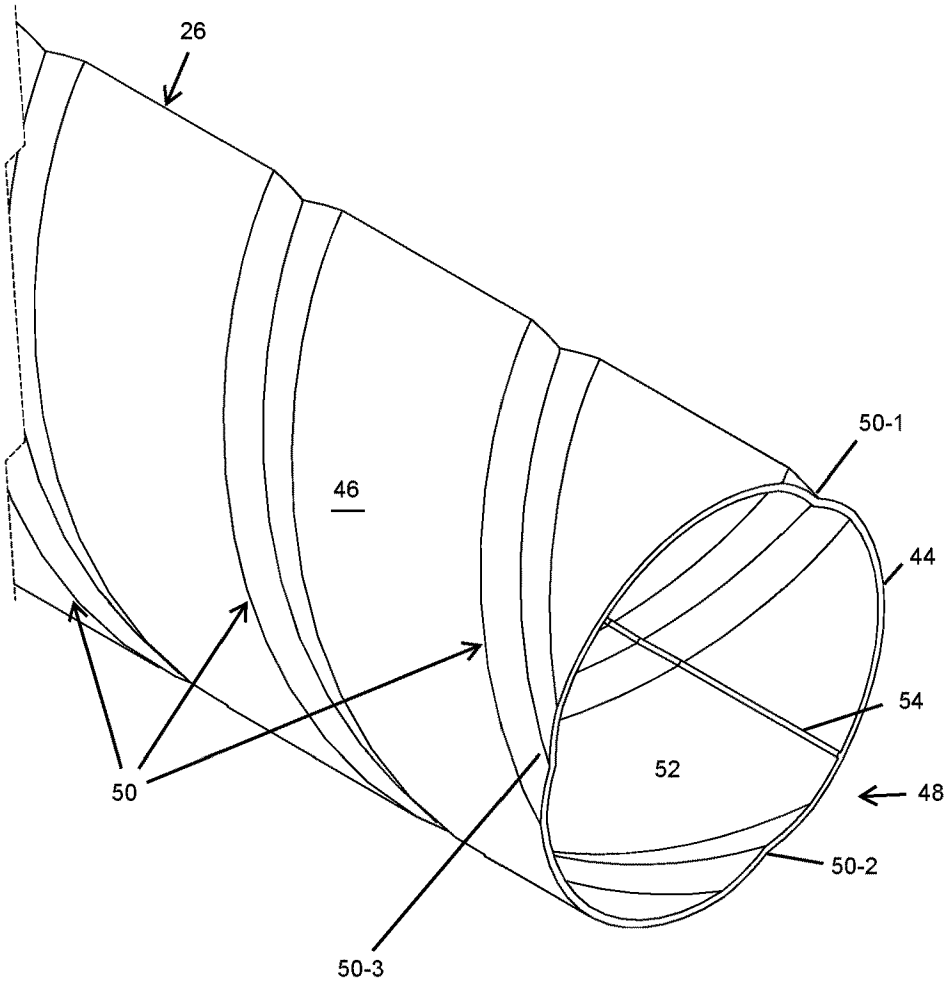
FIG. 15 is a perspective view of an end of the thin walled formed tube used as the drapery rod in the rotating drapery rod system shown in FIGS. 1-14, the view showing the interior feature on the interior surface of the hollow interior of the drapery rod which is a weld line.

In the arrangement shown, as one example, with particular reference to FIG. 15, three leads or grooves are presented as guide structure 50 (e.g. 50-1, 50-2, 50-3) that are equally spaced across the exterior surface 46 of drapery rod 26 (e.g. approximately 120 degrees from one another) and they rotate in a consistent manner across the length of drapery rod 26 from end 44 to end 44. However any other number of leads or grooves are hereby contemplated for use such as one, two, three, four, five, six, seven, eight, nine, ten, or more, which can be formed of all left hand guide structures, right hand guide structures or a combination of both which may be spaced from one another at any spacing.

In the arrangement shown, the grooves of guide structure 50 have a consistent angle of rotation throughout the length of the grooves from end 44 to end 44, and maintaining the position of the grooves within close tolerances throughout the length of the drapery rod 26. In an alternative arrangement, the grooves of guide structure 50 have varying pitch or angle of rotation along the length of drapery rod 26.

Drapery rod 26 includes a hollow interior 48. Hollow interior 48 is formed of any suitable size, shape and design and is configured to reduce the amount of material needed to form a drapery rod 26, as well as receive components of a system such as finials 30, a motor control assembly 32, or other elements. In the arrangement shown, as one example, hollow interior 48 includes an interior surface 52 which is generally smooth and cylindrical in shape and is positioned in approximate parallel spaced alignment to exterior surface 46. With that said, due to the wall thickness of drapery rod 26 the diameter of the interior surface 52 is less than the diameter of exterior surface 46.

In the arrangement shown, as one example, hollow interior 48 includes at least one interior feature 54 that protrude inward from the interior surface 52 which may be used to facilitate rotation of the drapery rod 26. In the arrangement shown, as one example, the interior feature 54 shown extends the length of the drapery rod 26 from end 44 to end 44.

Thin Walled Formed Tube:

In prior arrangements of a rotating drapery rod system, such as that shown in Applicant's commonly owned U.S. Pat. No. 9,095,908 issued Aug. 4, 2015, entitled Rotatable Drive Element for Moving A Window Covering which is fully incorporated by reference herein, as well as any related patents, the rotating drapery rod therein is comprised of a thick-walled rod with a guide structure that is machined into the exterior surface of the drapery rod using a complicated, time consuming and difficult secondary machining process which is performed after the rod is made. The thick walls of the drapery rod were required to provide sufficient material to form the guide structure in the rod using the machining process. In addition, the complicated machining process needed to be carefully and precisely controlled to ensure that the resulting grooves were precise and accurate and that there were no aberrations, burrs or other defects in the grooves, which had a tendency to create operational issues.

The thick walls of these machined drapery rods substantially increased the amount of the material that the drapery rod is formed of, which increases material cost. In addition, due to the thick walls, this required an expensive manufacturing process, such as extrusion to form the drapery rods themselves. As such, using thick walled drapery rods had substantial cost disadvantages due to the substantial amount of material that the tubes are formed of, complex and expensive manufacturing process for making the tubes themselves, and the complex, time consuming and expensive machining process for putting the grooves in the drapery rods. Another disadvantage of using these thick walled tubes for the drapery rod is that they are custom or specialty products that must be made to order which increases costs and lead times and substantially reduces the number of available suppliers.

In the arrangement shown, as an alternative to using a thick walled machined tube, a thin walled formed tube is used. To be clear, the term machining as is used herein is intended to mean a machining process where material is removed by a cutting or a grinding or the like process to place features in the drapery rod. As such, a machined tube is intended to mean a tube that has features formed in the tube through a machining process, which is a cutting or grinding or similar process. In contrast, the term formed used herein is intended to mean a forming process wherein features are placed in the drapery rod though a process that does not substantially remove material but instead deforms the drapery rod to form features therein. This forming process may be a stamping process, a compression process, a rolling process, a knurling process, a hammering process, an extrusion process, or any other process that forms features into the drapery rod 26, such as guide structure 50, using pressure and force without relying upon the removal of material to form the features, such as guide structure 50.

Using a thin walled formed tube provides substantial advantages. Using a thin walled formed tube also provides substantial disadvantages and challenges.

Advantages

Many advantages exist with respect to the use of a thin walled formed tube for drapery rod 26. One of the advantages of using a thin walled formed tube is that due to the thin walls the thin walled drapery rod 26 requires substantially less material as compared to a thick walled machined drapery rod 26. Using less material reduces the material cost. Another advantage of using a thin walled formed tube is that the tube may itself be formed by a faster and less expensive manufacturing process. That is, in one arrangement, the drapery rod 26 is formed by taking a sheet of material, such as steel, aluminum, an alloy, or any other metallic material or non-metallic material, and rolling it into a tubular shape and then joining the opposing ends using a manufacturing process such as welding, adhering, screwing, bolting, snap-fitting, friction fitting or any other process. In one arrangement, in the example shown in the figures, a welding process is used to join the opposing ends of the drapery rod 26. This welding process forms a seam that extends inward into the hollow interior 48 of drapery rod 26 a distance. It is this welded seam that in one arrangement is the feature 54 on the interior surface 52 of drapery rod 26 that drive coupler 42 connects to.

While manufacturing drapery rod 26 through this process of taking a sheet of material, rolling it and then welding it certainly has its challenges and is itself complex, it can be performed in a fast and less expensive manner when the process is optimized. As such, the manufacturing process for manufacturing a formed drapery rod 26 may be less expensive than custom-extruding a custom thick walled drapery rod 26. In addition, many formed thin walled tubes formed of various materials are readily available on the market. As such, another advantage is that these existing and common formed tubes may be utilized as the drapery rod 26 herein. Avoiding the need to use a custom-formed drapery rod 26 allows for a greater number of suppliers of drapery rod 26 to be used at a reduced cost. Also, this means that a readily available supply of formed drapery rods 26 may be used. Another advantage of using readily available formed tubes is that the manufacturers of these tubes have a great amount of experience manufacturing these tubes and they are very good at manufacturing them with tight tolerances and with high quality.

Another advantage of using a formed thin walled tube for drapery rod 26 is that the forming process does not have the potential to cut through the wall of the drapery rod 26. That is, one of the risks and disadvantages of machining the features in the exterior surface of the thick walled tubes is that the machining can cut through the wall of the tube in places. This may occur due to imprecision in the machining process, a thin spot in the wall of the rod or a combination thereof. When this occurs, the entire tube often needs to be scrapped, which wastes machine time and material and increases the overall cost of the product. Even if the machining process does not cut all the way through the wall of the tube, weak spots can be formed in the tube when the machining process gets close to the hollow interior of the tube. In contrast, when forming the features in the tube, this leads to less potential of cutting through the wall of the tube or forming thin spots in the wall of the tube, as compared to machining.

Disadvantages

Many disadvantages exist when it comes to using a formed tube and forming the guide structure 50 in the drapery rod 26. One such disadvantage is that another manufacturer must be relied upon to provide dimensionally accurate tubes, which in practice can vary substantially. That is, the interior diameter may vary substantially, the exterior diameter may vary substantially, the wall thickness may vary substantially, the straightness of the tubes may vary substantially, the smoothness of the tubes may vary substantially, and the welding seam, or feature 54, may vary substantially, the mechanical properties of the tubes may vary substantially (e.g. how strong they are, how much they bend, etc.), the material composition of the tubes may vary substantially, among others. This variance must be dealt with and accommodated when using these thin-walled formed tubes.

Another substantial disadvantage when using thin walled formed tubes for a rotating drapery rod system 10, as is shown herein, is that the thin walled formed tubes only have a single, small interior feature 54, on their interior surface 52. This interior feature 54 is a weld line where the opposing sides of the tube were welded together. Otherwise the interior surface 52 of drapery rod 26 is generally free of features.

This presents a problem in the rotating drapery rod system 10 presented herein as drapery rod 26 is rotated by motor 32. As the hollow interior 48 of these thin walled formed tubes only include the interior feature 54 which is a weld line, this is the only feature that can be used to grab onto when trying to grasp the drapery rod 26 from inside the hollow interior 48. However, this interior feature 54, which is a weld line, tends to be small and sporadic in shape and position, and can vary substantially from tube-to-tube, and manufacturer-to-manufacturer. As such, it is challenging to grip the drapery rod 26 from hollow interior 48 by using this interior feature 54 which is a weld line. This, coupled with the dimensional and other variances between tubes and between manufacturers, makes connecting to thin walled formed drapery rods 26 and rotating them from inside their hollow interior 48 very challenging. This is where drive coupler 42, as is described herein, is used.

Brackets:

Drapery rod system 10 includes brackets 28. Brackets 28 are formed of any suitable size, shape and design and are configured to attach drapery rod 26 to wall or other structure. In the arrangement shown, as one example, brackets 28, includes a mounting plate 56, a support arm 58, and a collar 60, among other features, components and structures.

In the arrangement shown, as one example, mounting plate 56 is configured to attach the brackets 28 to the wall or other structure. In the arrangement shown, as one example, mounting plate 56 is a generally square or rectangular member that connects to a wall in a generally flat and flush manner thereby connecting the drapery rod system 10 to the wall or structure.

In the arrangement shown, as one example, support arm 58 is configured to extend between mounting plate 56 and collar 60, while having an aesthetically pleasing appearance. Support arm 58 extends the collar 60 away from the wall or other structure a desired distance.

In the arrangement shown, as one example, collar 60 is configured to facilitate connection to drapery rod 26 while allowing rotation of drapery rod 26 while drapery rod 26 is held within opposing collars 60 of opposing brackets 28. In the arrangement shown, as one example, collar 60 is formed of a pair of opposing members that connect together around drapery rod 26 in a clamshell like manner. In the arrangement shown, as one example, collar 60 has a generally cylindrical exterior shape that is slightly larger than the exterior diameter of drapery rod 26. In the arrangement shown, as one example, the interior of collar 60 includes a shaped opening that receives an axle or other component of the drapery rod system 10 that both holds the drapery rod 26 while allowing it to rotate.

Brackets 28 may be formed of a single, unitary member or may be formed of a plurality of connected members that form brackets 28.

While two brackets are shown in use, any number of brackets are hereby contemplated for use, such as one bracket 28 also placed at the middle of an elongated drapery rod 26, a plurality of brackets between opposing ends 44 of drapery rod 26 or any other number of brackets 28, as is any configuration of brackets 28 hereby contemplated for use.

Finials:

In the arrangement shown, as one example, drapery rod system 10 includes finials 30 having a decorative element 62 and an extension 64. Finials 30 are formed of any suitable size, shape and design and are configured to improve the aesthetic appearance of drapery rod system 10.

In the arrangement shown, as one example, finials 30 include a decorative element 62 which may merely serve a decorative purpose. In the arrangement shown, as one example, this decorative element 62 is shown as a cylindrical shaped member placed at the end of extension 64, however any other shape, design or configuration is hereby contemplated for use.

In the arrangement shown, as one example, finials 30 include an extension 64. Extension 64 may serve decorative purposes, much like decorative element 62. Extension 64 may serve as a place to house components of drapery rod system 10 such as a motor control assembly 32 or other components. In the arrangement shown, as one example, extension 64 is configured to mimic the length of the drapery rod 26 and extends past the brackets 28. That is, in the arrangement shown, as one example, end 44 of drapery rod 26 connects to one side of collar 60 and extension 64 connects to the opposite side of collar 60 and extends outwardly therefrom a distance with a similar shape and alignment to that of drapery rod 26. The outward end of extension 64 connects to decorative element 62.

Finials 30 may be used to house and hold any mechanical or electronic component of the drapery rod system 10 in the hollow interior of finial 30. This includes housing the motor control assembly 32, power source 34, or any other component or portion or combination thereof.

Motor Control Assembly:

In the arrangement shown, as one example, drapery rod system 10 includes a motor control assembly 32. Motor control assembly 32 is formed of any suitable size, shape and design and is configured to facilitate motorized operation of drapery rod system 10. In the arrangement shown, as one example, motor control assembly 32 includes a motor controller 66, a microprocessor 68, memory 70, a receiver or transceiver 72 (transceiver), antenna 73, a printed circuit board 74 (PCB), a motor 76, a gearbox 78, and a connection assembly 80, among other components.

In the arrangement shown, as one example, a motor controller 66 is any component or combination of components that are configured to control operation of motor 76.

In the arrangement shown, as one example, microprocessor 68 is any computing device that is configured to receive inputs, processes these inputs according to information or instructions or software or code stored in memory 70 and output commands.

In the arrangement shown, as one example, memory 70 is any information storage device that is configured to receive information, store information and provide information on request of and/or for microprocessor 68. Memory 70 may be formed of flash, dram, ram, a hard-drive or any combination thereof or the like. Microprocessor 68 and memory 70 may be formed of a single combined unit, separate but operatively connected components, or a plurality of separate but operatively connected components or the like or any combination thereof.

In the arrangement shown, as one example, receiver or transceiver 72 may be formed of any communication device that facilitates signal transmission through wired or wireless communication. When operating in only a receive mode (one-way communication), transceiver 72 acts as only a receiver. When operating in send and receive mode (two-way communication), transceiver 72 acts both as a receiver as well as a transmitter.

In the arrangement shown, as one example, antenna 73 is formed of any component configured to receive wireless signals as well as transmit wireless signals in over the air communication and may be formed of a loop antenna, a fractal antenna, a slot antenna, a monopole antenna, or any other form of an antenna.

In the arrangement shown, as one example, printed circuit board 74 is configured of any structural component that is configured receive electrical components of the motor controller 66 while providing selected electrical isolation as well selected electrical connection between electronic components.

In the arrangement shown, as one example, motor 76 is any component that receives electric power and converts this power into motion. In the arrangement shown, as one example, motor 76 is a DC motor In the arrangement shown, as one example, gearbox 78 is any component that changes rotational speed of an output shaft of motor 76 to a desired speed through an arrangement of gears or other components.

In the arrangement shown, as one example, connection assembly 80 is any arrangement that facilitates connection of motor control assembly 32 to the other components of drapery rod system 10 such as brackets 28 and/or drapery rod 26 so as to facilitate operation of the drapery rod system 10.

In the arrangement shown, as one example, motor control assembly 32 extends from its outward end toward its inward end from connection assembly 80 to motor 76 to gearbox 78 to drive coupler 42.

In the arrangement shown, as one example, connection assembly 80 includes an axle 82 at its outward most end. Axle 82 is formed of any suitable size, shape and design and is configured to be held within the opening 84 in collar 60 of brackets 28 and to prevent rotation there between when connected and in place. In the arrangement shown, as one example, axle 82 is a generally square or rectangular protrusion that extends outward from the outward end of connection assembly 80 a distance. This square or rectangular axle 82 is sized and shaped to be received within a similarly sized and shaped opening 84 in collar 60, however any other corresponding shape is hereby contemplated for use. The corresponding shape and configuration of the square or rectangular axle 82 and opening 84 prevent rotation of connection assembly 80 when it is connected by axle 82 to opening 84.

In the arrangement shown, as one example, connection assembly 80 includes a flange 86 positioned just inward of axle 82 which connects to an extension 88. In the arrangement shown, as one example, flange 86 is generally cylindrical in shape and is sized and shaped to prevent insertion of motor control assembly 32 within the hollow interior 48 of drapery rod 26. That is, when motor control assembly 32 is inserted within the hollow interior 48 of drapery rod 26, the interior surface of flange 86 engages the end 44 of drapery rod 26 thereby preventing further insertion of motor control assembly 32 into the hollow interior 48 of drapery rod 26. In the arrangement shown, as one example, the exterior diameter of flange 86 is approximately that of the exterior surface 46 of drapery rod 26.

In the arrangement shown, as one example, an extension 88 extends inward from flange 86 a distance. In the arrangement shown, as one example, extension 88 is generally cylindrical in shape and is sized and shaped to fit within the hollow interior 48 of drapery rod 26 within close tolerances. As such, extension 88 is slightly smaller in diameter than flange 86. When assembled, extension 88 is positioned within the hollow interior 48 of drapery rod 26 whereas flange 86 remains just outside of the hollow interior 48 of drapery rod 26.

In one arrangement, a bearing (not shown) is positioned within connection assembly 80 which allows the rotation of the component that includes flange 86 and extension 88. In this arrangement, extension 88 is positioned within the hollow interior 48 of an end of drapery rod 26 and flange 86 positioned adjacent to and/or connected to an end 44 of drapery rod 26 and rotate with drapery rod 26 around axle 82. The other portions of motor control assembly 32, other than extension 88 and flange 86, remain stationary as drapery rod 26 rotates.

In the arrangement shown, as one example, a connection assembly 80 is connected to each end 44 of drapery rod 26. One connection assembly 80 is connected to holder 90, motor 76, gearbox 78 and drive coupler 42 connected to one end 44 of the drapery rod 26 and facilitates powered rotation of drapery rod. The other connection assembly 80 connected to the other end 44 of drapery rod 26 does not include holder 90, motor 76, gearbox 78 and drive coupler 42 and simply facilitates free rotation of drapery rod 26 which is driven by motor 76 connected adjacent the opposite end of drapery rod 26.

In the arrangement shown, as one example, a holder 90 is connected to and extends inward from the inward end of extension 88. Holder 90 is formed of any suitable size, shape and design and is configured to connect connection assembly 80 to the exterior end of motor 76. In the arrangement shown, as one example, holder 90 includes a wall 92 that forms a hollow interior 94. The inward end of holder 90 includes a plate 96 having a plurality of protrusions 98 therein. Plat 96 is configured to be affixed to the exterior end of motor 76 using one or more fasteners 100. When holder 90 is affixed to the exterior end of motor 76 the protrusions 98 of plate 96 are received within recesses 102 in the exterior end of motor 76. The combination of the engagement between the protrusions 98 of holder 90 with the recesses 102 of motor 76 as well as the connection of fasteners 100 through plate 96 and into the exterior end of motor 76 prevent rotation or movement of motor 76 relative to holder 90.

In the arrangement shown, as one example, an output shaft 104 extends outward from the outward end of motor 76. A magnetic member 106 is connected to the output shaft 104 that extends outward from the outward end of motor 76. In the arrangement shown, as one example, this magnetic member 106 is a magnetic wheel that is separated into a plurality of magnetic segments, each having a different polarity, which may be sensed as the magnetic wheel is rotated to provide speed and position and other operational data.

In the arrangement shown, as one example, when holder 90 is connected to the outward end of motor 76, output shaft 104 and magnetic member 106 extend into the hollow interior 94 of holder 90. In the arrangement shown, as one example, a board 108, such as a printed circuit board, is positioned within the hollow interior 94 of holder 90 and includes one or more sensors 110 thereon. These sensors 110 are placed adjacent to magnetic member 106 and within sensing distance of magnetic member 106 such that when magnetic member 106 rotates the one or more sensors 110 detect the rotation which is transmitted to the motor control assembly 32 (or more specifically the microprocessor 68) which counts and tracks the signals and from which can determine the speed, direction and position, as well as any operational limits, such as when an opening motion has reached its end, fully opened, position.

In the arrangement shown, as one example, sensors 110 are what are known as Hall Effect sensors, which sense the passing of magnetic fields as magnetic member 106 is rotated. However, any other form of a sensor is hereby contemplated for use such as a reed switch, an optical sensor, a magnetic sensor, a mechanical sensor or the like or any other sensor that is capable of sensing rotation of output shaft 104. In the arrangement shown, as one example, one sensor is positioned on each side of the magnetic member 106. By providing two sensors 110, one on each side of magnetic member 106, this provides greater clarity and greater accuracy of data.

In the arrangement shown, as one example, an electrical lead 112 connects to board 108 within the hollow interior 94 of holder 90 and extends outward therefrom. In the arrangement shown, as one example, electrical lead 112 extends outward through an opening in the center of axle 82. In the arrangement shown, as one example, the outward end of electrical lead 112 includes a plug 114 thereon that is configured to electrically connect to other components of the system 10.

In the arrangement shown, as one example, the inward end of output shaft 104 extends outward from the inward end of motor 76 and connects to gearbox 78. Gearbox 78 itself has an output shaft 116 that connects to drive coupler 42, as is further described herein.

The components of motor control assembly 32 may be co-located at or near the same position or place, or these components may be separated by distance and electrically connected to one another. Furthermore, each of the components of motor control assembly 32 may be separated into a plurality of components which may be located at different locations. As an example, memory 70 may be formed of a plurality of memory components located at different positions of the drapery rod system 10, some on board and others are external, that are electrically connected to one another and operate in cooperation with one another.

In one arrangement, electrical lead 112 extends out of motor control assembly 32 and out of the end of drapery rod 26, through collar 60 of bracket 28 and into the hollow interior of finial 30 (extension 64 and/or decorative element 62). In this arrangement, other electrical components of motor control assembly 32 are housed and held within the hollow interior of finial 30 which are electrically connected to the electrical components of motor control assembly 32 positioned within the end 44 of drapery rod 26. In another arrangement, electrical lead 112 extends out of drapery rod 26 and connects to a controller 117. Controller 117 may be formed of any suitable size, shape and design and may include some or all of the electrical components of motor control assembly 32 that are needed to control operation of drapery rod system 10. In the arrangement shown in FIG. 1, as one example, controller 117 is includes a battery tube 118 that houses and holds power source 34, which in the arrangement shown is a plurality of batteries 120 held within battery tube 118. In one arrangement, controller 117 also includes one or more buttons, switches or other devices that are used to control operation of drapery rod system 10 that may be used to start or stop operation of the rotating drapery rod 26. In one arrangement, controller 117 may be pulled or lifted to initiate movement or stop movement or reverse movement. In one arrangement, controller 117 (or other portions of motor control assembly 32) include a light sensor, a temperature sensor, and/or any other form of a sensor that is utilized to initiate automated movement of the drapery rod system 10.

In the arrangement shown, as one example, battery tube 118 is formed as an elongated cylindrical member and houses a plurality of batteries 120 that form power source 34. Use of an external battery tube provides the benefit of being able to place the power source 34 at any external position in a hidden manner behind shade material 12. Alternatively, power source 34 may be positioned within drapery rod 26 or finials 30 and/or within brackets 28, or within any other component of the drapery rod system 10. However, any other configuration of power source 34 is hereby contemplated for use.

In an alternative arrangement, electrical lead 112 extends out of drapery rod 26, bracket 28, or another component of drapery rod system 10 and electrically connects to direct line voltage, solar cell, or any other form of power. In an alternative arrangement, electrical lead 112 extends out of drapery rod 26, bracket 28, or another component of drapery rod system 10 and electrically connects to a central controller system, such as a central controller computer, a power panel or another component that provides power as well as control signals to drapery rod system 10 that control operation of drapery rod system 10.

Shade Material:

Drapery rod system 10 includes shade material 12. Shade material 12 is formed of any suitable size, shape and design and is generally configured of a piece of material that hangs from drapery rod 26 by connection to rings 35. Shade material 12 is configured of a piece of material that serves both aesthetic purposes as well as light control or filtering purposes. For one way opening draperies, shade material 12 may be formed of one piece of shade material 12, whereas in center opening or closing draperies shade material 12 may be formed of more than one piece of shade material 12. In the arrangement shown, as one example, shade material 12 extends from an upper edge 122 to a lower edge 124 and between opposing side edges 126 in a generally panel like manner.

In the arrangement shown, as one example, shade material 12 is connected at its upper edge 122 to a plurality of rings 35 that are positioned around drapery rod 26. As rings 35 move along the length of the drapery rod 26 shade material 12 is moved from an open position to a closed position or from a closed position to an open position.

Rings:

Drapery rod system 10 includes a plurality of rings 35. Rings 35 are formed of any suitable size, shape and design and are generally configured to facilitate connection of shade material 12 and drapery rod 26 while allowing movement of shade material 12 along the length of drapery rod 26. In the arrangement shown, as one example, there are three similar rings 35 that form part of the system 10 that generally include idler rings 36, partial driver rings 38, and full driver rings 40. Idler rings 36, partial driver rings 38, and full driver rings 40 all include a hoop member 128, an interior member 130, and a connection member 132 among other components, features, and the like.

Hoop Member:

In the arrangement, as one example, hoop member 128 is formed of a generally cylindrical member that is configured to fit around drapery rod 26. In the arrangement shown, as one example, when viewed from the front, hoop member 128 is generally narrow in width as compared to the length of drapery rod 26. In the arrangement shown, as one example, when viewed from the side, hoop member 128 is a relatively thin cylindrical member having a hollow interior. Hoop member 128 serves both a structural purpose as well as an aesthetic purpose. Aesthetically, hoop member 128 is configured to have a pleasing aesthetic appearance, and may have the same surface treatment or appearance of that as the drapery rod 26. Structurally, hoop member 128 is formed of a durable and/or rigid member that has the strength to support shade material 12 while moving shade material 12 between an open and closed position along drapery rod 26. While a cylindrical hoop member 128 is shown, hoop member 128 may take on any other shape or design such as square, rectangular, octagonal, or any other suitable or aesthetically pleasing design. In one arrangement, hoop member 128 is formed of a metallic material to provide optimum strength of rigidity as well as to match the material of drapery rod 26 (which is generally metallic material). Hoop member 128 is configured to house and hold an interior member 130.

Interior Member:

In the arrangement shown, as one example, interior member 130 is formed of a generally cylindrical member that is configured to fit around drapery rod 26 as well as within hoop member 128. In the arrangement shown, as one example, when viewed from the front, interior member 130 is generally narrow in width as compared to the length of drapery rod 26 and is sized and shaped to fit within hoop member 128. In the arrangement shown, as one example, when viewed from the side, interior member 130 is a relatively thin cylindrical member having a hollow interior. Interior member 130 is configured to fit within hoop member 128. In the arrangement shown, as one example, the interior surface of interior member 130 is generally flat and smooth and curves in a generally cylindrical concave manner and engages the exterior surface 46 of drapery rod 26. In one arrangement, the interior surface of interior member 130 includes a guide member 134. This guide member 134 may be formed of any suitable size, shape and design and is configured to closely fit around the exterior surface of drapery rod 26 so as to provide alignment and guidance of rings 35 as they move along a length of drapery rod 26, as well as to provide stability to rings 35 as they pass over guide structure 50, as well as to prevent rings 35 from tilting and or binding on drapery rod 26, as well as to reduce noise and facilitate quieter sliding of the rings 35 across drapery rod 26.

In one arrangement, as stated earlier, drapery rod 26 and or hoop member 128 are formed of a metallic material for strength, rigidity, durability, and aesthetic purposes. While metallic materials provide these benefits, metallic materials have substantial drawbacks including they generate high levels of noise and have vibration transmission issues. In one arrangement, to minimize noise and vibrational issues, interior member 130 is formed of a non-metallic material such as a plastic, a composite, a nylon, a polymer, UHMW material, or any other non-metallic material. In one arrangement, interior member 130 and/or guide member 134 is formed of a material which has a low coefficient of friction and/or is self-lubricating so as to facilitate low frictional sliding across a length of drapery rod 26 as well as quiet operation. In one arrangement, interior member 130 and/or guide member 134 is formed of a material which has a lower durometer than the materials which form drapery rod 26 and/or hoop member 128 so as to facilitate vibrational dampening and/or noise reduction. In this way, forming interior member 130 out of a non-metallic material when drapery rod 26 and/or hoop member 128 are formed of a metallic material provide substantial operational advantages.

The elements of guide member 134 described herein apply to idler rings 36, partial driver rings 38, and full driver rings 40.

In a one-way opening drapery application, a plurality of idler rings 36 are positioned around the drapery rod 26 on the non-opening side. The number of idler rings 36 needed depends on the length of the drapery rod 26 as well as the property of the materials of the shade material 12. Positioned on the opening side of the plurality of idler rings 36 is a full driver ring 40. Positioned on the opening side of the full driver ring 40 is a partial driver ring 38.

In a center opening and/or center closing drapery application, a plurality of idler rings 36 are positioned around the drapery rod 26 on the outward sides of drapery rod 26. The number of idler rings 36 needed depends on the length of the drapery rod 26 as well as the property of the materials of the shade element 12. Positioned on the inward side of the plurality of idler rings 36 is a full driver ring 40. Positioned on the inward side of the full driver ring 40 is a partial driver ring 38.

The arrangement of a plurality of idler rings 36 followed by a full driver ring 40 followed by a partial driver ring 38 provides operational advantages, namely a partial driver ring 38 drives itself along the length of drapery rod 26 while allowing the full driver ring to "crush" the shade material 12 at the fully closed position, which means to cause the full driver ring 40 to either engage directly the partial driver ring 38 or thereby engage in close proximity the partial driver ring 38, which has the effect of forcing an increased amount of shade material 12 at the fully closed position, which has the effect of reducing light gaps in the shade material 12 at the fully closed position.

As the drapery rod 26 rotates, the rings 35 are driven along the length of the drapery rod 26 to move the shade material 12 between and opened and a closed position. More specifically, full driver ring 40 engages the guide structure 50 of drapery rod 26 which causes linear movement of full driver ring 40 along the length of drapery rod 26. As the full driver ring 40 linearly moves along drapery rod 26, full driver ring 40 has a tendency to push or pull idler rings 36 and partial driver ring 38 as the shade material 12 moves between the opened position and the closed position.

Idler Rings:

Drapery rod system 10 includes a plurality of idler rings 36. Idler rings 36 are formed of any suitable size, shape and design and are generally configured to facilitate connection of shade material 12 and drapery rod 26 while allowing movement of shade material 12 along the length of drapery rod 26. In the arrangement shown, as one example, idler rings 36 have hoop member 128 and an interior member 130 that may include a guide member 134. Idler rings 36 are configured to allow free sliding across a length of drapery rod 26. As such, the interior surface interior member 130 of idler rings 36 is smooth and free of any features or teeth or other members that engage guide structure 50. As such, when shade material 12 is connected to idler ring 36, positioned around drapery rod 26, shade material 12 can be easily pulled and/or slid along a length of drapery rod 26. As idler ring 36 moves along the length of drapery rod 26 the interior surface of interior member 130 slides over the exterior surface 46 of drapery rod 26. In addition, due to the material properties of the non-metallic material that forms interior member 130 as idler ring 36 moves over drapery rod 26, the material which forms the interior member 130 absorbs vibrations, reduces noise, and provides smooth, low friction sliding.

In the arrangement shown, as one example, guide member 134 of idler rings 36 when viewed from the side is a partial portion of a cylindrical member that is sized and shaped to fit around the exterior surface 46 of drapery rod 26.

Partial Driver Ring:

Drapery rod system 10 includes at least one partial driver ring 38. More specifically, center opening drapery rod systems 10 include a pair of partial driver rings 38 positioned at the center of drapery rod 26 and inward of full driver ring 40 and a plurality of idler rings 36. One-way opening drapery rod systems 10 include one partial driver ring 38 positioned at the closing side of the drapery rod 26 and inward of full driver ring 40 and a plurality of idler rings 36.

In the arrangement shown, as one example, partial driver ring 38 is similar to, if not identical to, idler ring 36 with one difference being the inclusion of at least one tooth on the interior surface of guide member 134 of interior member 130. This tooth is formed of any suitable size, shape and design and is formed to engage guide structure 50 of drapery rod 26 so as to help facilitate linear movement along the length of drapery rod 26.

In one arrangement, as one example, this tooth is positioned at the approximate top and center of the partial driver ring 38. This arrangement provides the functional advantage that as shade material 12 pulls downward on partial driver ring 38 through its connection to connection member 132, this causes the tooth to be pulled downward into maximum engagement with guide structure 50. However, any other arrangement is hereby contemplated for use where the tooth or multiple teeth are positioned at other positions along partial driver ring 38. In one arrangement, interior member 130 may be moved or rotated with respect to hoop member 128 so as to adjust the position of the tooth. Alternatively, connection member 132 may be moved relative to interior member 130 and or hoop member 128 so as to adjust the position of the tooth.

During operation of drapery rod system 10, as drapery rod 26 is rotated, due to the weight of shade material 12 pulling down on partial driver ring 38, this causes the tooth to engage with guide structure 50. As the drapery rod 26 is rotated, the engagement between the tooth and guide structure 50, coupled with the downward force on partial driver ring 38, causes partial driver ring 38 to laterally move along the length of drapery rod 26. This lateral movement continues until partial driver ring 38 engages non-movable object such as bracket 28 or a stop, such as at the fully closed position, at which point partial driver ring 38 no longer moves laterally which causes the tooth to come of out of guide structure 50 as the drapery rod 26 continues to rotate. As the drapery rod 26 continues to rotate, while partial driver ring 38 is not engaged with guide structure 50, this allows full driver ring 40 to drive closer toward partial driver ring 38, thereby crushing the shade material 12 at the fully closed position, thereby reducing light gaps.

Full Driver Ring:

Drapery rod system 10 includes at least one full driver ring 40. More specifically, center opening drapery rod systems 10 include a pair of full driver rings 40, where full driver rings 40 are positioned between a plurality of idler rings 36 and a partial driver ring 38. One-way opening drapery rod systems 10 include one full driver ring 40 positioned between a plurality of idler rings 36 and a partial driver ring 38.

In the arrangement shown, as one example, full driver rings 40 are similar to partial driver rings 38 with one difference being guide member 134 does not terminate as a partial portion of a cylinder or circle, and instead the guide member 134 extends around the exterior diameter of the drapery rod 26. In the arrangement shown, as one example, like partial driver rings 38, full driver rings 40 include a tooth positioned at the upper center of the interior surface of guide member 134 of interior member 130. Like the tooth of partial driver ring 38, this upper tooth of full driver ring 40 is formed of any suitable size, shape and design and is formed to engage guide structure 50 of drapery rod 26 so as to facilitate linear movement along the length of drapery rod 26 as shade material 12 pulls downward on full driver ring 40.

In the arrangement shown, as one example, a second tooth is positioned on the bottom center of the interior surface of guide member 134 of interior member 130. In this arrangement, the first tooth and the second tooth are arranged on opposite sides of guide member 134 from one another so as to match the spacing and placement of the features of guide structure 50. While two teeth are shown in use, any number of teeth are hereby contemplated for use and are configured to correspond in size, shape and placement to the features of guide structure 50. As another example, in the arrangement shown wherein drapery rod 26 includes three grooves that form guide structure 50, three teeth may be present in the interior surface of the guide member 134 of interior member 130, one for each groove. Again, any other number and arrangement of teeth are hereby contemplated for use.

As one example, when drapery rod 26 includes only a single groove as guide structure 50, guide member 134 of full driver ring 40 includes only a single tooth positioned at the top-center (or any other position) of guide member 134. As another example, as is shown, when drapery rod 26 includes a pair of grooves as guide structure 50, guide member 134 of full driver ring 40 includes a pair of opposed teeth, which in the example shown, are positioned at the top-center and bottom center of guide member 134, however any other position is hereby contemplated for use. As another example, when drapery rod 26 includes three equally spaced of grooves as guide structure 50, guide member 134 of full driver ring 40 includes a three equally spaced teeth, which in one example includes a tooth positioned the top-center guide member 134, and a pair of teeth positioned approximately one hundred and twenty degrees along the interior surface of guide member 134. Any other arrangement is hereby contemplated for use.

In the arrangement shown, as one example, the interior diameter of the interior surface of guide member 134 of full driver ring 40 is sized and shaped to fit around the exterior surface of drapery rod 26 with close and tight tolerances, while still allowing for smooth, easy and low friction sliding of full driver ring 40 along the length of drapery rod 26. As opposing teeth extend inward from interior surface of guide member 134 the inner diameter of the inward end of these teeth are less than the exterior diameter of drapery rod 26. Said another way, these teeth extend inward from the interior surface of guide member 134 a greater distance than the dimensional tolerances between the interior diameter of guide member and the exterior surface 46 of drapery rod 26. As such, when full driver ring 40 is positioned around drapery rod 26, these teeth are engaged within guide structure 50. As the guide member 134 of full driver ring 40 fully extends around the exterior diameter 46 of drapery rod 26 with close and tight tolerances, these teeth are prevented from skipping out of or coming disengaged from guide structure 50 as drapery rod 26 is rotated. As such, when drapery rod 26 is rotated, full driver ring 40 is forced to move laterally along the length of drapery rod 26. This is in contrast to partial driver ring 38 which, due to the guide member 134 only extending around a portion of the drapery rod 26, is allowed to jump out of or skip out of engagement with guide structure 50 so as to allow free rotation of drapery rod 26 while partial driver ring 38 remains stationary and/or disengaged.

During operation of drapery rod system 10, as drapery rod 26 is rotated, the teeth of full driver ring 40 are engaged with the grooves of guide structure 50 of drapery rod 26. Due to the weight of shade material 12 pulling down on full driver ring 40, this maintains the vertical orientation of full driver ring 40 and prevents full driver ring 40 from rotating as drapery rod 26 rotates. As the drapery rod 26 is rotated, the engagement between the teeth of full driver ring 40 and guide structure 50, coupled with the downward force on full driver ring 40, causes full driver ring 40 to laterally move along the length of drapery rod 26. Due to the direct engagement of full driver ring 40 with drapery rod 26, the operational limits, the fully opened and fully closed positions, are programmed and controlled by motor control assembly 32. Motor control assembly 32 powers motor 76 to rotate drapery rod 26 until full driver ring 40 reaches its desired position along drapery rod 26 at which point power to the motor 76 is terminated.

As drapery rod 26 is rotated, full driver ring 40 causes movement of the idler rings 36 and partial driver ring 38.

In an opening operation, when starting at a fully closed position, partial driver ring 38 tends to be in engagement with or within close proximity of a bracket 28 with full driver ring 40 is positioned in engagement with or in close proximity of partial driver ring 36 and idler rings 36 tend to be spaced out along the length of drapery rod 26 with the outward most ring positioned on the side of a bracket opposite partial driver ring 38 and full driver ring 40. As drapery rod 26 is rotated, the engagement of full driver ring 40 with guide structure 50 has a tendency to move full driver ring 40 toward the open position along the length of drapery rod 26. As drapery rod 26 is rotated, full driver ring 40 has a tendency to push the idler rings 36 as full driver ring 40 moves toward the open position. In an opening operation, partial driver ring 36 when engaged with guide structure 50 may drive under its own power, however at other times partial driver ring 36 is pulled along the length of drapery rod 26 by full driver ring 40 toward the open position. The full driver ring 40 continues to move toward the open position until full driver ring 40 compacts the plurality of idler rings 36 between bracket 28 and full driver ring 40. This causes a compressed stack of shade material 12 at the opening end of drapery rod 26 when shade material 12 is in the fully opened position.

In a closing operation, when starting at a fully opened position, the plurality of idler rings 36 are positioned within close proximity of one another between the bracket 28 at the open position and full driver ring 40. As drapery rod 26 is rotated, the engagement of full driver ring 40 with guide structure 50 has a tendency to pull the trailing idler rings 36 as full driver ring 40 moves toward the closed position. In a closing operation, partial driver ring 36 when engaged with guide structure 50 may drive under its own power however when partial driver ring 38 is disengaged from guide structure 50 full driver ring 40 will push partial driver ring 36 toward the closed position.

This lateral movement continues until partial driver ring 38 engages non-movable object such as bracket 28 or a stop, such as at the fully closed position, at which point partial driver ring 38 no longer moves laterally which causes the tooth to come of out of guide structure 50 as the drapery rod 26 continues to rotate. As the drapery rod 26 continues to rotate, while partial driver ring 38 is not engaged with guide structure 50, this allows full driver ring 40 to drive closer toward partial driver ring 38, thereby crushing the shade material at the fully closed position, thereby reducing light gaps.

In the arrangement shown, as one example, the partial driver ring 38 is allowed to disengage the guide structure 50 by the guide member 134 only fitting partially around the drapery rod 26. By guide member 134 only fitting around a portion of drapery rod 26, this allows partial driver ring 38 to selectively move out of engagement with guide structure 50 when the forces moving linearly are greater than the forces of moving vertically. Similarly, by guide member 134 only fitting around a portion of drapery rod 26 this allows partial driver ring 38 to move back into engagement with guide structure 50 when the partial driver ring 38 is pulled downward by the weight of shade material 12 into engagement with guide structure 50. In contrast to this arrangement of partial driver ring 38, the guide member 134 of full driver ring 40 extends around the entire exterior diameter of drapery rod 26, which prevents the teeth of full driver ring 40 from selectively moving in or out of engagement with guide structure 50.

As the drapery rod 26 rotates, guide members 134 of idler rings 36 and partial driver rings 38 help to smooth the operation of drapery rod system 10 as it moves between open and closed position by guiding these rings 35, by holding the exterior surface of drapery rod 26 with close and tight sliding tolerances. In addition, the material properties of guide members 134 helps to absorb vibration and noise and helps to smooth guidance of rings 35 over drapery rod 26. In addition, the operation of the full driver ring 40 that cannot escape engagement with guide structure 50 in concert with partial driver ring 38 that may escape engagement ring of guide structure 50 allows for crushing of the shade material 12 at fully closed position thereby reducing or eliminating light gaps.

Drive Coupler:

As is described herein, utilizing formed thin walled tubes as drapery rod 26 has many advantages, such as a ready supply of off the shelf tubes, low material cost, low manufacturing cost, among other advantages. One substantial challenge associated with using formed thin walled tubes as drapery rod 26 is that it is very difficult to connect to the interior surface 52 of hollow interior 40 of these drapery rods 26 to impart rotation on the drapery rod 26 by motor 76. This is because prior to forming the guide structure 50 in the exterior surface 46 of drapery rod 26 the interior surface 52 of hollow interior 40 of drapery rod 26 is relatively smooth with the only feature being interior feature 54 which is a seam line from a welding operation where the opposing sides of drapery rod 26 were welded together. In many formed rods, this interior feature 54 has a low profile. That is, when drapery rod 26 is viewed from an end 44, interior feature 54 is relatively narrow from side-to-side and protrudes into the hollow interior 48 only a short distance. Making matters more-difficult is that this interior feature 54, which in many cases is a weld line or weld seam, is not tightly dimensionally controlled. That is, the dimensions and shape of this interior feature 54 may vary substantially along the length of drapery rod 26 from end 44 to end 44.

Another substantial challenge associated with using formed thin walled tubes as drapery rod 26 is that when the guide structure 50 is formed in the exterior surface 46 of drapery rod 26 this causes indentations the interior surface 52 of drapery rod 26 that extend inward into the hollow interior 48 of drapery rod 26. Making matters more-difficult, these indentations can vary substantially in shape, depth and position along the length of drapery rod 26 from end 44 to end 44.

In the arrangement shown, as one example, despite these challenges, a drive coupler 42 is used to connect to the interior surface 52 of hollow interior 48 of drapery rod 26. In one arrangement, this drive coupler 42 connects to interior feature 54.

Drive coupler 42 is formed of any suitable size, shape and design and is configured to engage and lock onto the interior surface 52 of hollow interior 48 of drapery rod 26. In the arrangement shown, as one example, drive coupler 40 includes a main body 136, a plurality of connection members 138 and a drive lug 140, among other features, components and structure.

Main body 136 is formed of any suitable size, shape and design and is configured to be inserted into the hollow interior 40 of an end 44 of drapery rod 26 and facilitate connection between the drive lug 140 and output shaft 116 of gearbox 78 on one side and connection members 138 on the other side so as to facilitate connection to the hollow interior 48 of drapery rod 26. In the arrangement shown, as one example, main body 136 is formed of a generally cylindrical member having an exterior surface 142 that is generally smooth and cylindrical or circular in shape when viewed from an end. In the arrangement shown, as one example, when viewed from an end, the generally cylindrical exterior surface 142 includes one or more, and in the arrangement shown three, flat sections 144. These flat sections 144 include recesses 146 positioned in the approximate center of the flat sections 144 that are configured to receive connection members 138.

These flat sections 144 provide relief or space for the outward ends of connection members 138 to extend outward from the main body 136 a distance. This relief of flat sections 144 also allows for accommodation of aberrations on the interior surface 52 of drapery rod 26.

When viewed from an end, recesses 146 are generally triangular in shape, with the flat section 144 cutting off the point of the triangle that extends through the plane of the flat section 144.

In one arrangement main body 136 is formed of a compressible and/or flexible non-metallic material that is strong enough and rigid enough to endure use, however it is soft enough to absorb vibrations and reduce noise. In one arrangement, main body 136 is formed of a plastic material, neoprene material, a rubber material, a foam material, a composite material, an ultra-high molecular weight material, or any other composite or non-metallic material or a combination thereof. Main body 136 may be a solid object, a hollow object or it may have a plurality of structural members that extend through and/or throughout main body 136.

In the arrangement shown, as one example, main body 136 extends a length from an outward end 148 to an inward end 150. In the arrangement shown, as one example, outward end 148 and inward end 150 extend in approximate planar spaced relation to one another and extend in approximate perpendicular alignment to the end-to-end length of main body 136.

In the arrangement shown, as one example, recesses 146 extend from outward end 148 to inward end 150 in a generally consistent and continuous manner. In the arrangement shown, as one example, as main body 136 is somewhat flexible, in one arrangement, connection members 138 are slid into main body 136 from an end 148, 150. While connection members 138 may be slid into an end of drive coupler 142, when drive coupler 142 is rotated around its central axis, connection members 138 do not unintentionally become dislodged from drive coupler 142 due to the forces during rotation on connection members 138 being approximately perpendicular to the end-to-end length of recesses 146. As such, connection members 138 may be slid into recesses 146 from an end 148, 150 but they will not unintentionally dislodge during use.

In one arrangement, to help ensure connection members 138 remain in recesses 146, recesses 146 are sized and shaped to apply a friction fit on connection members 138 when they are in place within recesses 146. In another arrangement, an adhesive is used to bind connection members 138 to recesses 146. In another arrangement, the exterior surface of connection members 138 are roughened so as to impart increased friction and engagement between connection members 138 and recesses 146. In another arrangement, a mechanical arrangement is utilized that affixes connection members 138 to recesses 146, which may be stapling, crimping, riveting, screwing, bolting, snap-fitting, friction fitting or any other mechanical process. Any combination of these arrangements may be used to connect and hold connection members 138 to recesses 146, as well as any other method or means of connecting two components together.

In the arrangement shown, as one example, connection members 148, when viewed from an end 148, 150 are generally triangular in shape, and in the arrangement each length of the triangle is generally equal to one another, which is also known as an equilateral triangle. In the arrangement shown, these triangular shaped connection members 138 include a center wall 152 that is generally flat and straight. Center wall 152 connects at its outward ends to end walls 154, which are also generally flat and straight. Each end wall 154 terminates on an end 156 opposite center wall 152 which is positioned just shy of connecting to the other end wall 154. As such, in this arrangement, a slot 158 is positioned between opposing ends 156 of end walls 154 of connection members 138. This slot 138 is generally centrally positioned with respect to the center wall 152.

In the arrangement shown, as one example, to ensure that connection members 138 are held within recesses 146, the material of main body 136 covers the entire exterior surface of center wall 152 and extends approximately half way up the exterior surface of end walls 154 before terminating in flat sections 144. In this way, triangular shaped connection members 138 are captured within the material of main body 136.

In the arrangement shown, as one example, when connection members 138 are positioned within recesses 146, the ends 156 of end walls 154 of connection members 138 extend outward from the material of main body 136 a distance, past the plane formed by flat sections 144, in a generally centered arrangement within the flat sections 144 of main body 136. In one arrangement, while the flat sections 144 interrupt the generally cylindrical exterior surface 142 of main body 136, the ends 156 of connection members 138 are positioned in approximate alignment with the exterior diameter of main body 136 if it continued around and was not interrupted by flat sections 144. In an alternative arrangement, the ends 156 of connection members 138 extend just slightly past the exterior diameter of main body 136. In an alternative arrangement, the ends 156 of connection members 138 are recessed just slightly to the exterior diameter of main body 136.

In the arrangement shown, as one example, connection members 138, when viewed from an end 148, 158, are formed of planar piece of material that is folded at its corners at the intersection of center wall 152 and end walls 154. In the arrangement shown, as one example, connection members 138 are formed of a metallic material that is strong and durable. In one arrangement, spring steel or hardened spring steel is used due to its extreme hardness and strength, however any other metallic material is hereby contemplated for use. In an alternative arrangement, a hard, non-metallic material is used. One benefit of using a metallic material for connection members 138 is that using a metallic material is very durable and provides a strong connection to drapery rod 26. In one arrangement, when the material used for connection members 138 is harder than the material used for drapery rod 26, the ends 156 of connection members 138 may cut into the softer material of the drapery rod 26 upon insertion, thereby helping to securely, and in some arrangements permanently, affix drive coupler 42 to drapery rod 26. This can occur, for example, when hard spring steel is used for connection members 138 and softer aluminum is used for drapery rod 26. Another benefit of using hard metallic materials for connection members 138 is that the point or edge at the inward sides of ends 156 which form slots 158 tend to bite and hold onto interior feature 54 in a secure manner due to the sharpness of this interior edge coupled with the hardness of the connection member 138 coupled with the softness of the material of drapery rod 26 and interior feature 54.

In one arrangement, the ends 156 of end walls 154 are cut or terminate in approximate planar spaced relation to that of the plane formed by flat sections 144. This arrangement causes the exterior edge of opposing ends 156 to have an obtuse angle, and the interior edge of ends 156 to have an acute angle. This arrangement of obtuse exterior edges and acute interior edges helps to guide interior feature 54 into the slot 158 between opposing ends 156 of end walls 154 as the feature 54 easily slides over the obtuse angle at the exterior of end walls 154; while capturing the feature 54 within the slot 158 as the feature 54 does not easily move past the acute, or sharp edge, of the interior surface of ends 156. As such, the obtuse exterior angle and the acute interior angle serve as a trap that allows the connection member 138 to easily slide over feature 54, while preventing the escape of feature 54 from within slot 158.

In the arrangement shown, as one example, an opening 160 is positioned in the outward end 148 of main body 136 of drive coupler 42. This opening 160 is sized and shaped to receive drive lug 140 therein. Drive lug 140 is formed of any suitable size, shape and design and is configured to connect the main body 136 of drive coupler 42 to the output shaft 116 of gearbox 78. In the arrangement shown, as one example, drive lug 140 has a generally gear-teeth shaped exterior peripheral edge 162 that connects to a generally cylindrical shaped end wall 164 at its outward most edge.

In the arrangement shown, as one example, opening 160 in the outward end 148 of main body 136 of drive coupler 42 is sized and shaped to receive drive lug 140 therein within close and tight tolerances. In one arrangement, drive lug 140 is formed of a metallic material, wherein main body 136, as is described herein, is formed of a non-metallic material. In this arrangement, in one arrangement, the material of main body 136 is pliable enough to allow drive lug 140 to be inserted within main body 136. In one arrangement, to help ensure drive lug 140 remain in main body 136, opening 160 is sized and shaped to apply a friction fit on drive lug 140 when it is in place within opening 160. In another arrangement, an adhesive is used to bind drive lug 140 when it is in place within opening 160. In another arrangement, the exterior surface of drive lug 140 is roughened so as to impart increased friction and engagement between drive lug 140 when it is in place within opening 160. In another arrangement, a mechanical arrangement is utilized that affixes drive lug 140 when it is in place within opening 160, which may be stapling, crimping, riveting, screwing, bolting, snap-fitting, friction fitting or any other mechanical process. Any combination of these arrangements may be used to connect and hold drive lug 140 when it is in place within opening 160, as well as any other method or means of connecting two components together. The shape of drive lug 140 and the manner in which it is connected to main body 136 helps to ensure that softer main body 136 rotates when harder drive lug 140 rotates.

In the arrangement shown, as one example, drive lug 140 includes an opening 166 at its middle that is sized and shaped to receive an output shaft 116 of gearbox 78. In the arrangement shown, as one example, opening 166 is non-round in nature so as to facilitate transmission of rotation of output shaft 116 to drive lug 140, which transmits this rotation to main body 136. In the arrangement shown, as one example, opening 166 is circular in shape with a flat section, which corresponds in size and shape to output shaft 116.

In the arrangement shown, as one example, the inward end 150 of main body 136 includes an opening 168 which is sized and shaped to receive a clip 170 that is configured to be attached to the inward most end of output shaft 116 after it is inserted into opening 166 of drive lug 140 and through a portion of the material of main body 136. The use of clip 170 ensures that output shaft 116 does not come unintentionally dislodged from drive coupler 42. Clip 170 may be a one-way pressure clip, a screw, a bolt, a pin, a nut or any other member that connects two components together.

In this way, the softer main body 136 of drive coupler is connected to the rigid output shaft 116 of gear box 116 and the harder connection members 138 are connected to main body 136.

In Operation:

In the arrangement shown, as one example, drive coupler 42 is installed on the inward most end of output shaft 116 of gearbox 78 by inserting the end of output shaft 116 into the opening 166 in drive lug 140. Thereafter, clip 170 is inserted into the opening 168 on the inward end 150 of main body 136 and is inserted over the inward end of output shaft 116 after it is inserted through drive lug 140 and through a portion of the material of main body 136 thereby locking output shaft 116 to drive coupler 42.

Once the drive coupler 42 is installed on the end of output shaft 116 the drive coupler 42 and motor control assembly 32 is installed into the hollow interior 48 of drapery rod 26 through an end 44. As the drive coupler 42 is inserted into the hollow interior 48 of drapery rod 26, close and tight tolerances between the interior diameter of the hollow interior 48 and the exterior diameter of the drive coupler 42 exist. Or more specifically the exterior surface 142 coupled with the position of the ends 156 of end walls 154 of connection members 138 is within close and tight tolerances with the interior surface 52 of hollow interior 48. In one arrangement, a frictional engagement is present, which requires force to insert drive coupler 42 into the hollow interior 48. In one arrangement, as one example, as is shown in FIG. 16, when drive coupler 42 is installed into the hollow interior 48 of drapery rod 26, the rounded exterior surface 142 of drive coupler 42 as well as the ends 156 of connection members 138 are in frictional engagement with the interior surface 52 of hollow interior 48 of drapery rod 26.

Figure 16:
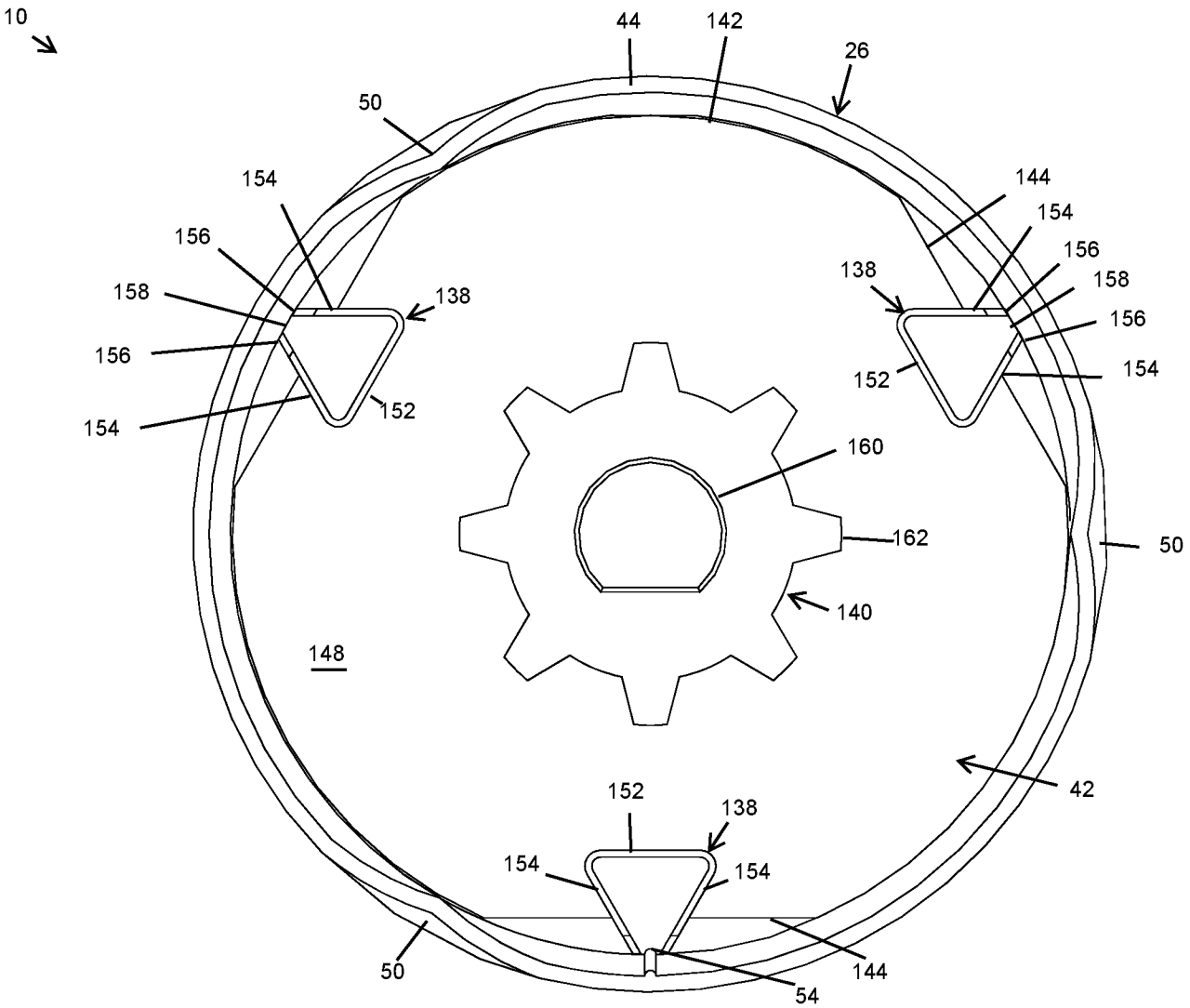
FIG. 16 is an elevation view of an end of the thin walled formed tube used as the drapery rod in the rotating drapery rod system shown in FIGS. 1-15, the view showing the drive coupler positioned in the hollow interior of the drapery rod; the view showing the exterior surface of the drive coupler in engagement with the interior surface of the drapery rod; the view showing the interior feature, which is a weld line, in the interior surface of the drapery rod captured within the slot between the opposing ends of opposing end walls of a connection member thereby locking the drive coupler in place on the drapery rod.
Figure 17:
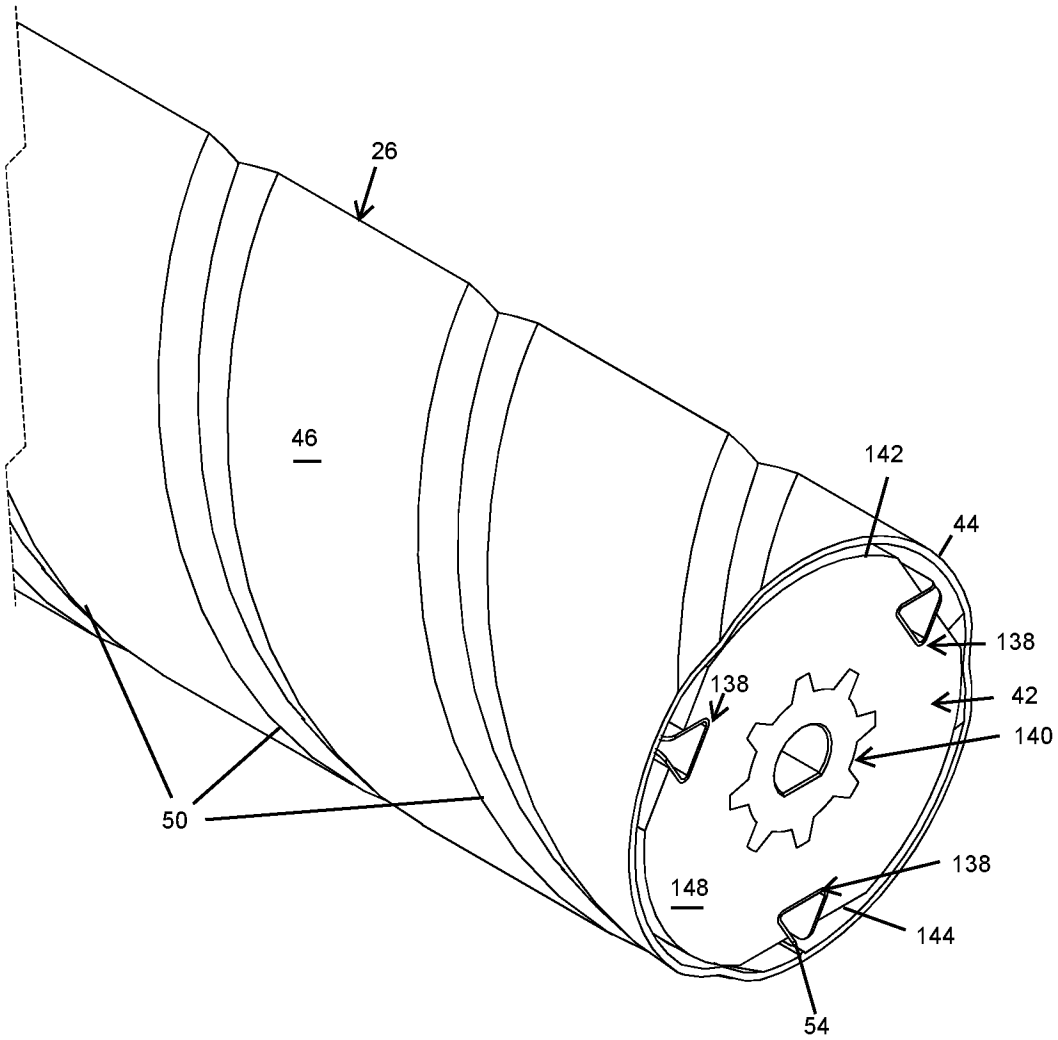
FIG. 17 is a perspective view of the end of the drapery rod with the drive coupler positioned within the hollow interior of drapery rod as is shown in FIG. 16.
Figure 18:
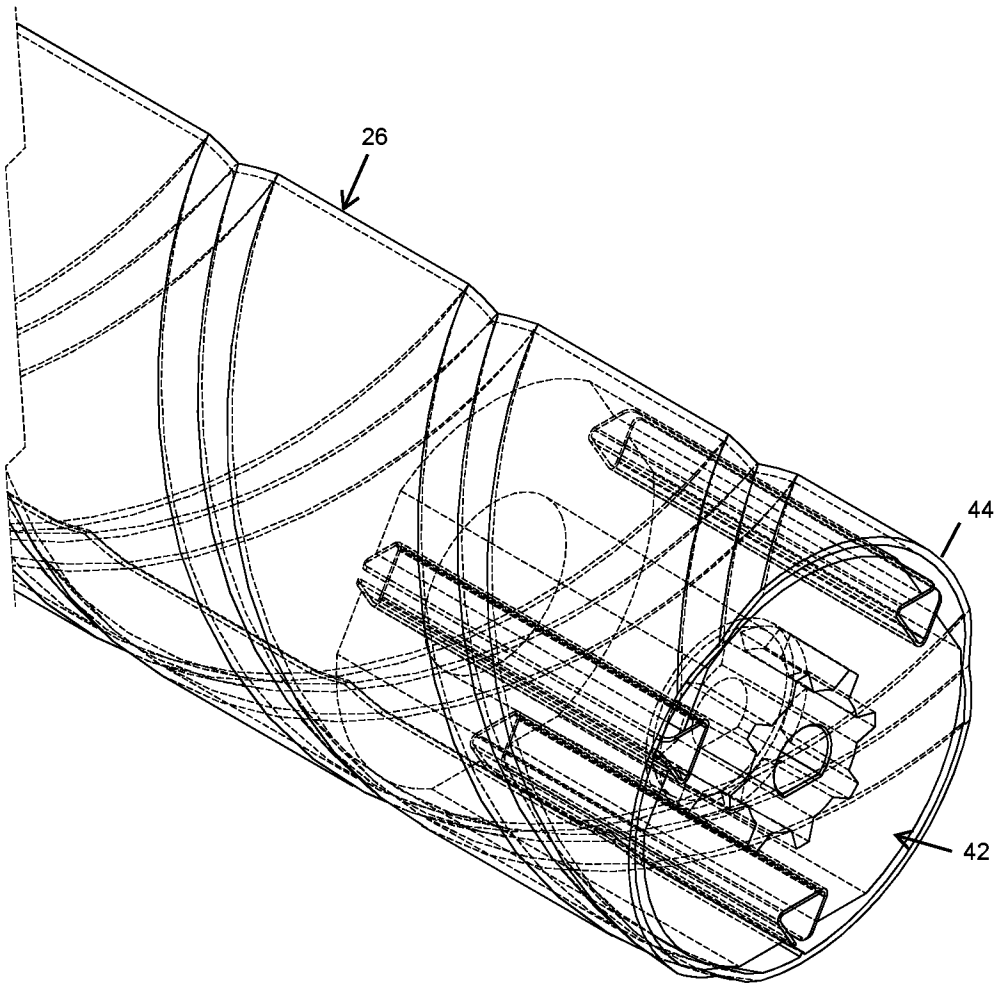
FIG. 18 is a transparent view of the view shown in FIG. 17.
Figure 19:
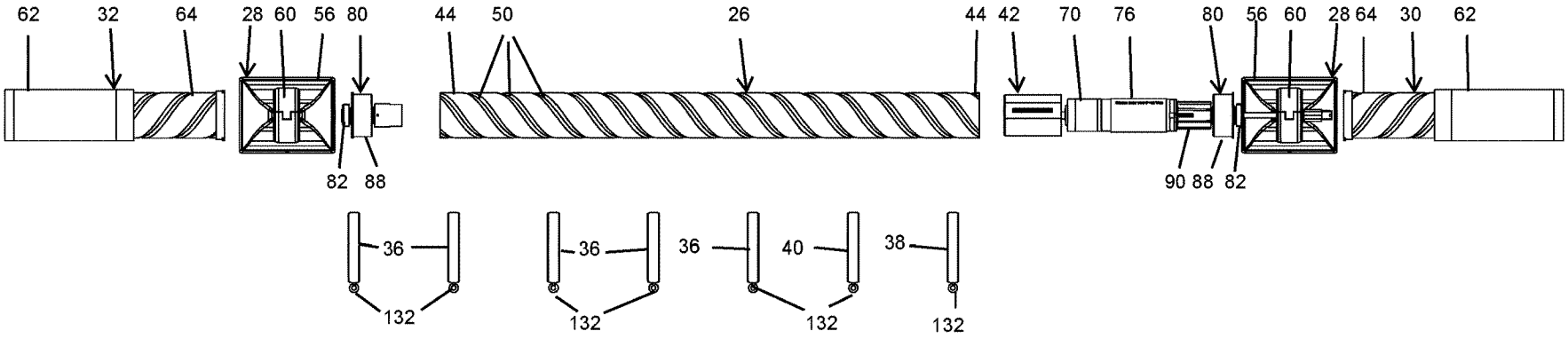
FIG. 19 is a front elevation exploded view of an alternative arrangement of a rotating drapery rod system having a drive coupler with connection members that are captured within the material of the main body of the drive coupler so as to prevent the connection members from sliding out of the drive coupler.
Figure 20:
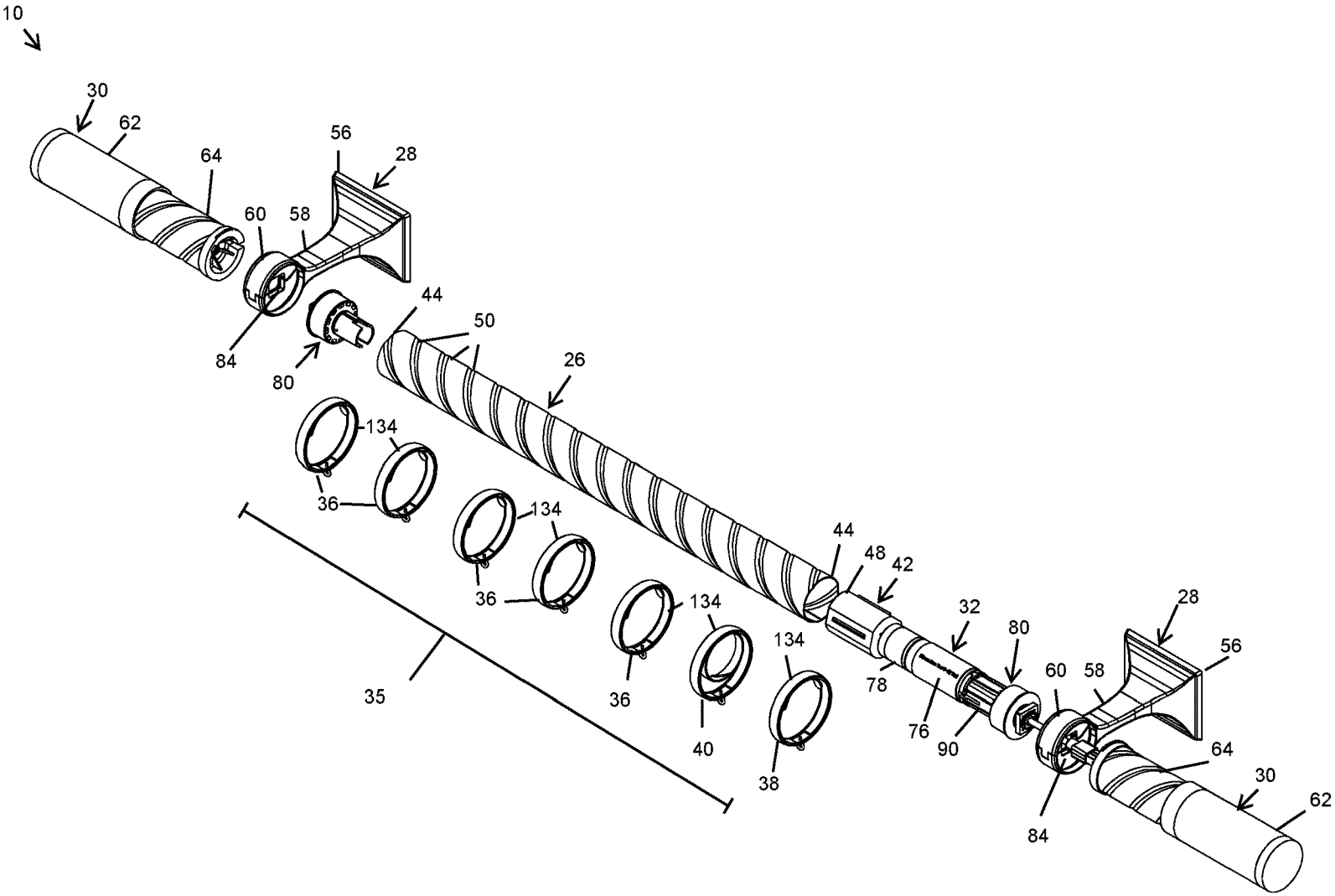
FIG. 20 is an exploded perspective view of the alternative arrangement of a rotating drapery rod system shown in FIG. 19.
Figure 21:
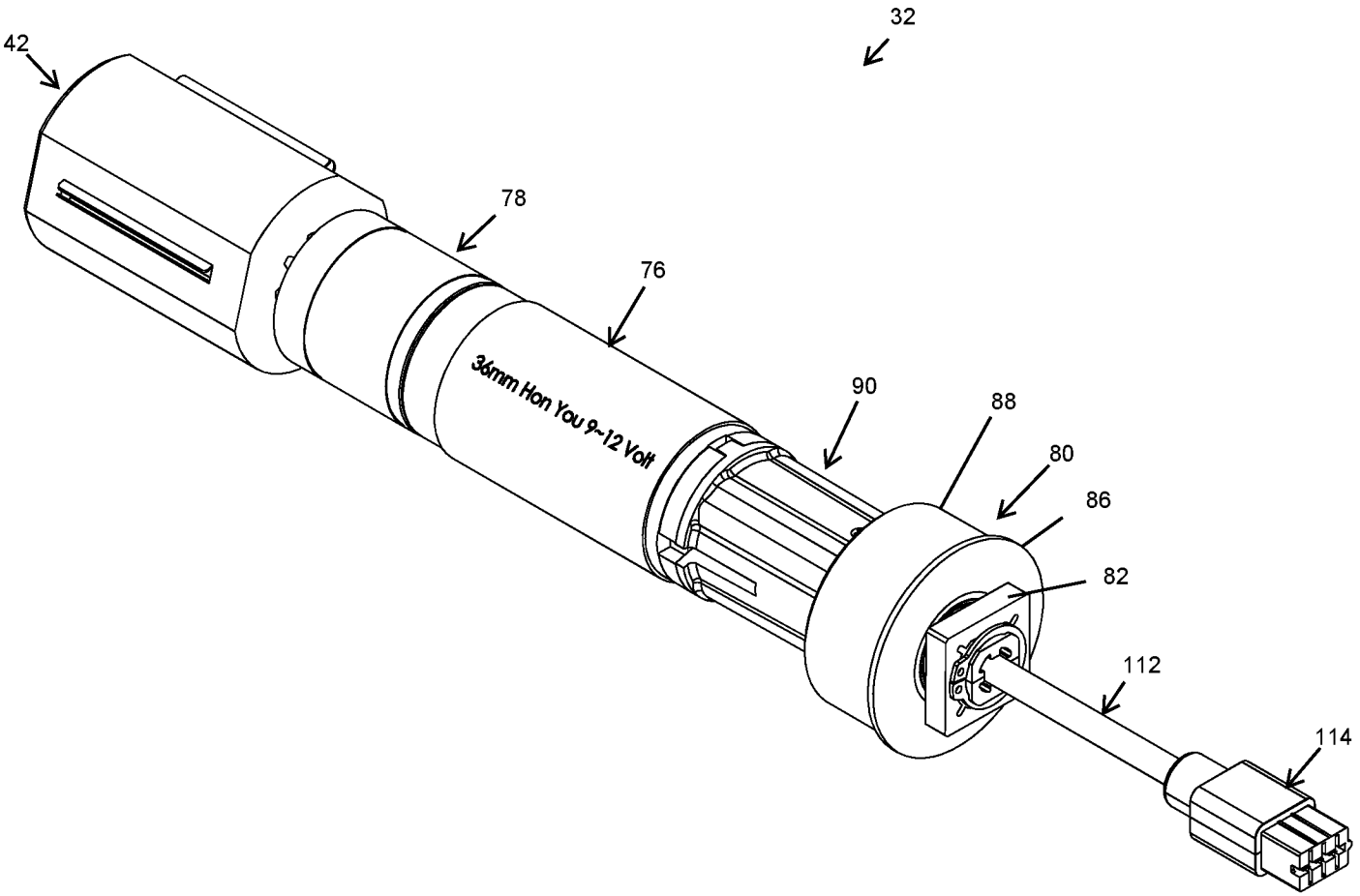
FIG. 21 is a perspective view of a motor control assembly of the alternative arrangement of a rotating drapery rod system shown in FIGS. 19-20.
Figure 22:
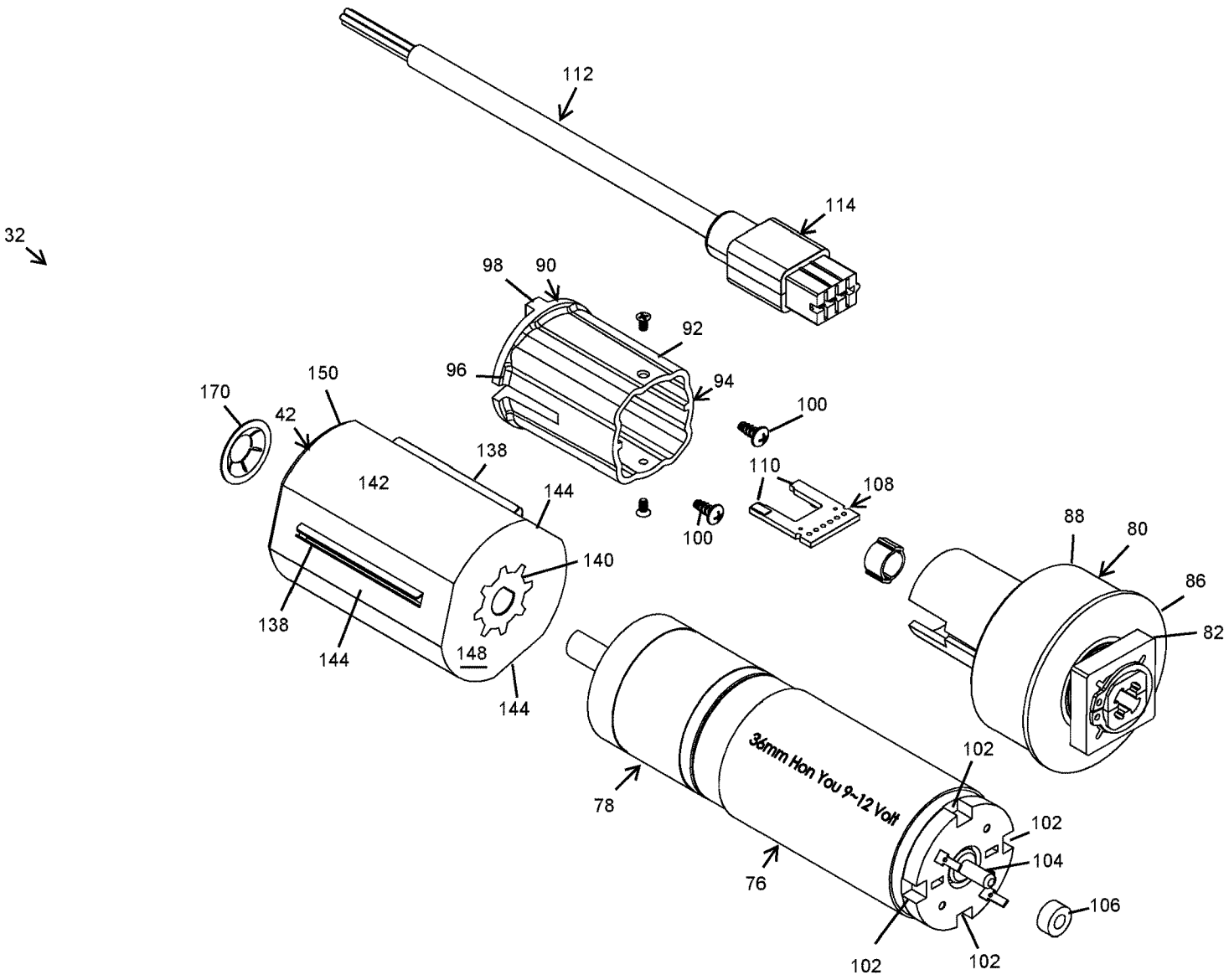
FIG. 22 is an exploded perspective view of a motor control assembly of the alternative arrangement of a rotating drapery rod system shown in FIG. 21.
Figure 23B:
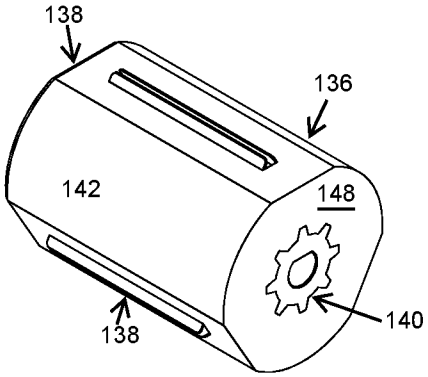
FIG. 23B is a perspective view of the outward end of main body of a drive coupler of the alternative arrangement of a rotating drapery rod system shown in FIGS. 19-22.
Figure 23A:
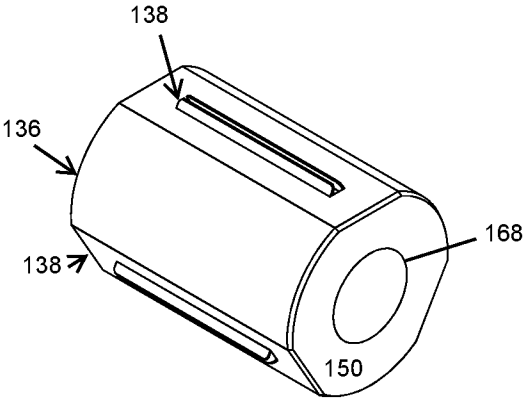
FIG. 23A is a perspective view of the inward end of main body of a drive coupler of the alternative arrangement of a rotating drapery rod system shown in FIGS. 19-22.
Figure 23E:
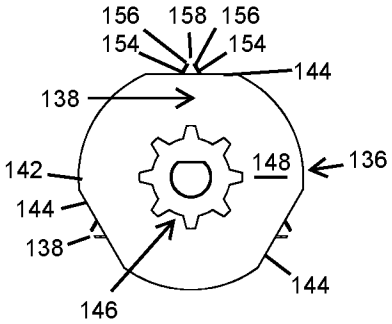
FIG. 23E is an elevation view of the outward end of main body of a drive coupler of the alternative arrangement of a rotating drapery rod system shown in FIGS. 19-22.
Figure 23D:
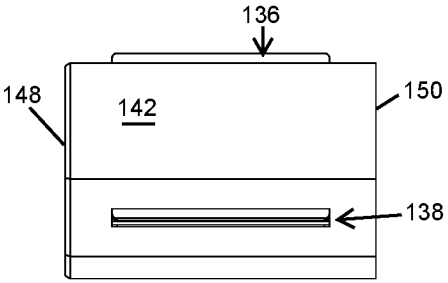
FIG. 23D is an elevation view of the side of main body of a drive coupler of the alternative arrangement of a rotating drapery rod system shown in FIGS. 19-22.
Figure 23C:
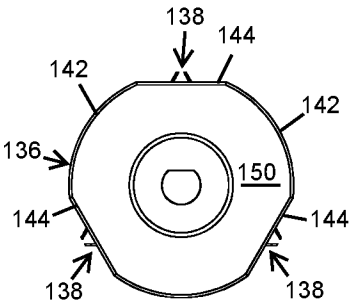
FIG. 23C is an elevation view of the inward end of main body of a drive coupler of the alternative arrangement of a rotating drapery rod system shown in FIGS. 19-22.
Figure 24:
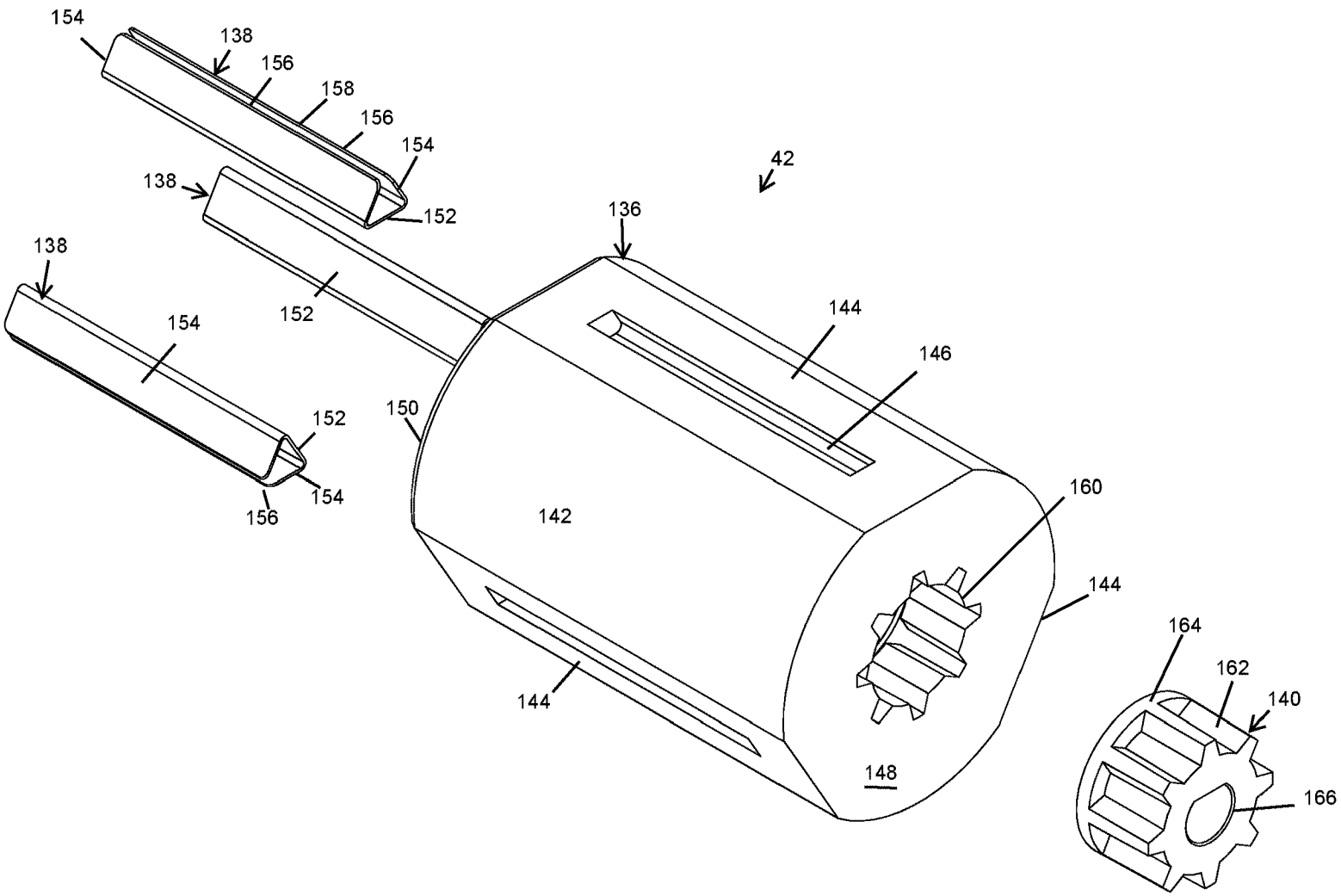
FIG. 24 is an exploded perspective view of the outward end of main body of a drive coupler of the alternative arrangement of a rotating drapery rod system shown in FIGS. 19-23
Figure 25:
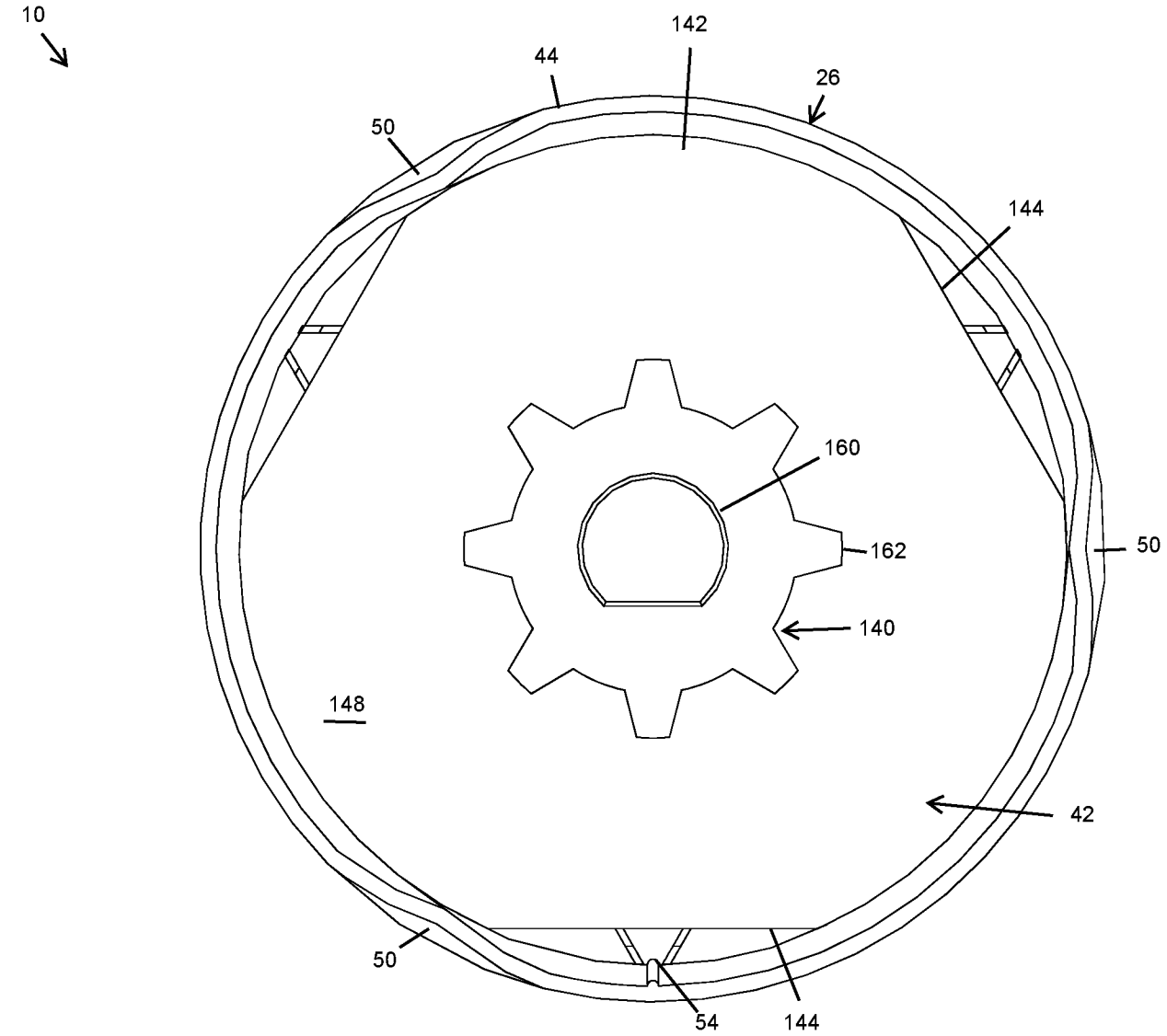
FIG. 25 is an elevation view of an end of the thin walled formed tube used as the drapery rod in the alternative arrangement of a rotating drapery rod system shown in FIGS. 19-24, the view showing the drive coupler positioned in the hollow interior of the drapery rod; the view showing the exterior surface of the drive coupler in engagement with the interior surface of the drapery rod; the view showing the interior feature, which is a weld line, in the interior surface of the drapery rod captured within the slot between the opposing ends of opposing end walls of a connection member thereby locking the drive coupler in place on the drapery rod.
Figure 26:
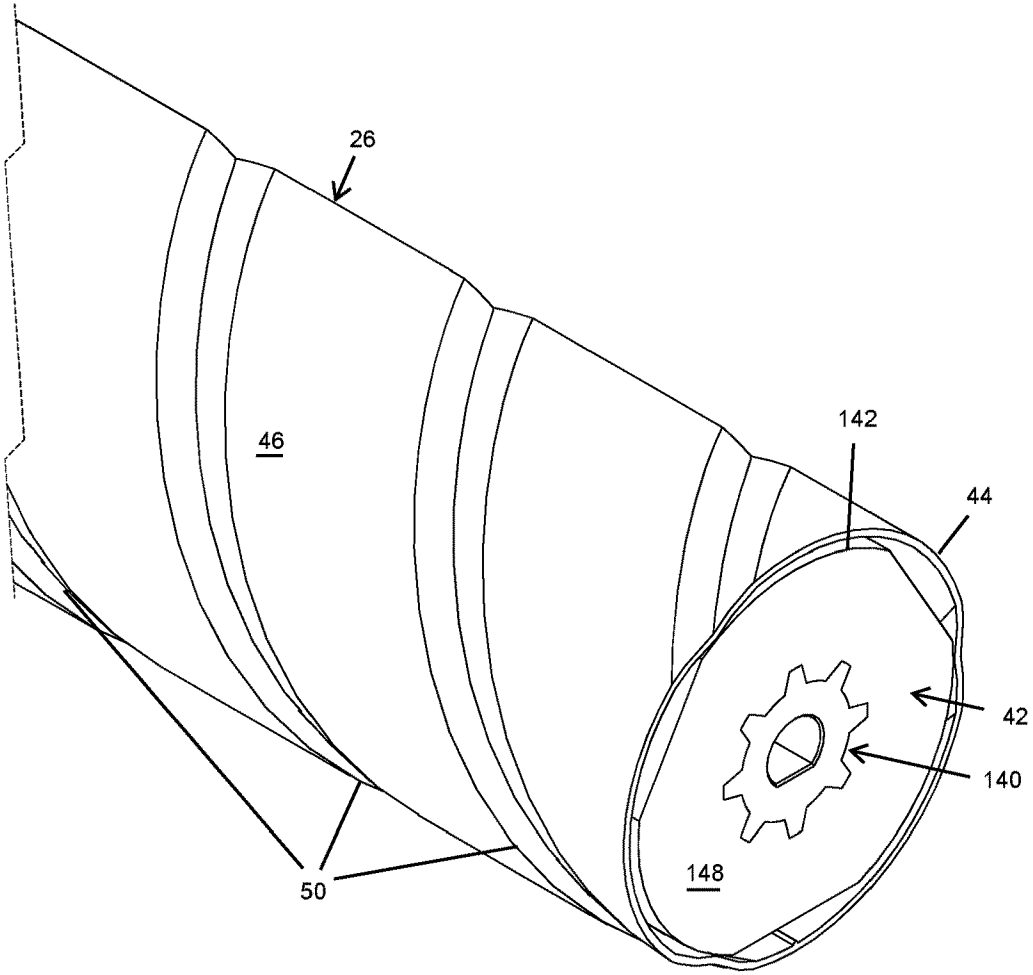
FIG. 26 is a perspective view of the end of the alternative arrangement of a drapery rod with the drive coupler positioned within the hollow interior of drapery rod as is shown in FIG. 25.
Figure 27:
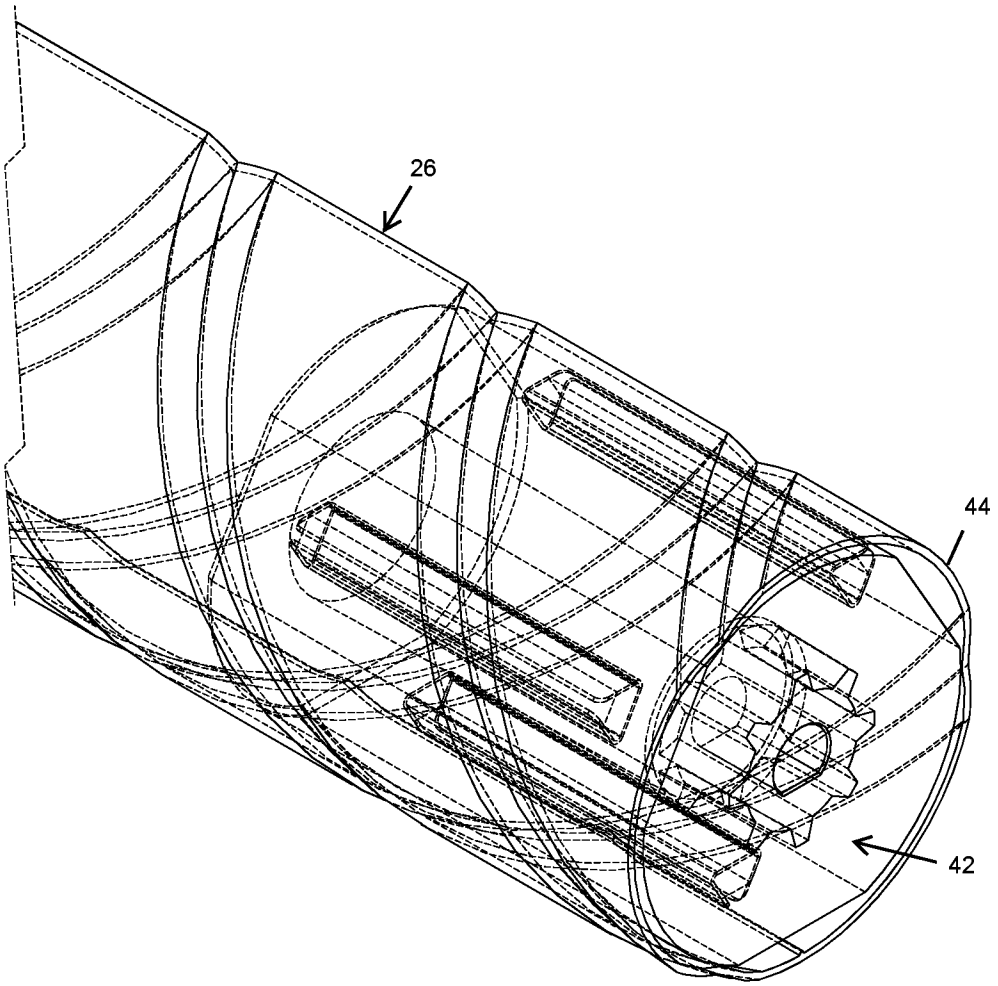
FIG. 27 is a transparent view of the view shown in FIG. 26.

In one installation arrangement, it is desired to capture the interior feature 54, which in the arrangement shown in FIG. 16 is a weld seam, within the slot 158 of a connection member 138 initially. In one arrangement, the slot 158 of connection members 138 is aligned with the interior feature 54 and the drive coupler 42 is slid into the hollow interior 48 of the drapery rod 26, thereby capturing the interior feature 54 within slot 158 of a connection member 138 of the drive coupler 42.

In an alternative installation arrangement, during installation it is not needed to capture the interior feature 54 within the slot 158 of any one connection member 138 initially. Instead, drive coupler 42 may simply be inserted within the hollow interior 48 of drapery rod 26 without regard for the position of interior feature 54. When the motor 76 is powered up for the first time, drive coupler 42 will rotate within the hollow interior 48. In this arrangement, the exterior surface 142 and the ends 156 of connection members 138 will slide over the interior surface 52 of drapery rod 26 until an exterior corner of an end 156 of a connection member 138 engages the interior feature 54. When this occurs, the obtuse angle of the exterior side of the end 156 will slide over the interior feature 54, due to this obtuse angle. However, once the interior feature 54 is captured within the slot 158 the acute angles on the interior edges of ends 156 prevent the interior feature from coming out of the slot 158. In this way, the drive coupler 42 is locked onto the thin walled formed tube of the drapery rod 26 and rotation is imparted onto the drapery rod 26 by motor 76.

Once installed in this way, the metallic connection members 138 maintain a strong hold on the interior surface 52 of hollow interior 48 while the compressible material of main body 136 provides some give and helps to reduce the transmission of noise and vibrations from motor 76 to drapery rod 26 and from drapery rod 26 to other components of the system 10.

Alternative Arrangements of Connection Members:

In one arrangement, connection members 138 are essentially formed of a triangular member with a point cut off in a parallel-planar manner to the center wall 152. This leads to an obtuse angle at the exterior side of the end 156 of end walls 154 and an acute angle on the interior edges of ends 156 of end walls 154.

In an alternative arrangement, connection members 138 are formed out of an elongated rectangular sheet of metallic material. This sheet of metallic material is then folded at the corners on each side of center wall 152 such that the ends 156 of end walls 154 terminate at slot 158 after folding. This use of a rectangular sheet of material that is then folded, leads to a point at the outward end 156 of end walls 154 of connection members 138. This is shown, as a demonstrative example, in FIG. 28. FIG. 29 illustrates a derivation of the connection member 138-2 illustrated in FIG. 28. The connection member 138-2 of FIG. 29 is essentially the same as the connection member 138 of FIG. 28 except that the end walls terminate in a relatively flat outward end 156-2 rather than a point. In the alternative, the ends 156-2 may have an arcuate shape having a radius of curvature about the same as the radius of curvature of the interior surface 152 of the hollow interior 48.

Figure 28:
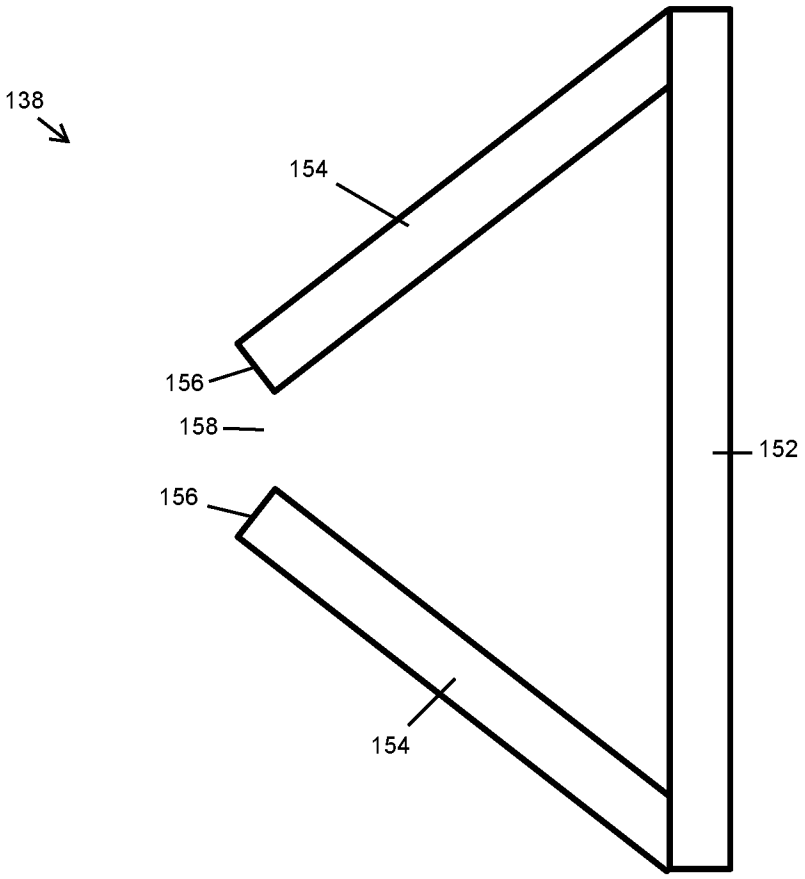
FIG. 28 is a demonstrative view of one arrangement of a connection member formed of a folded piece of rectangular metallic material which results in a squared point at the inward most edge of the ends of end walls that engage the interior surface of the drapery rod.
Figure 29:
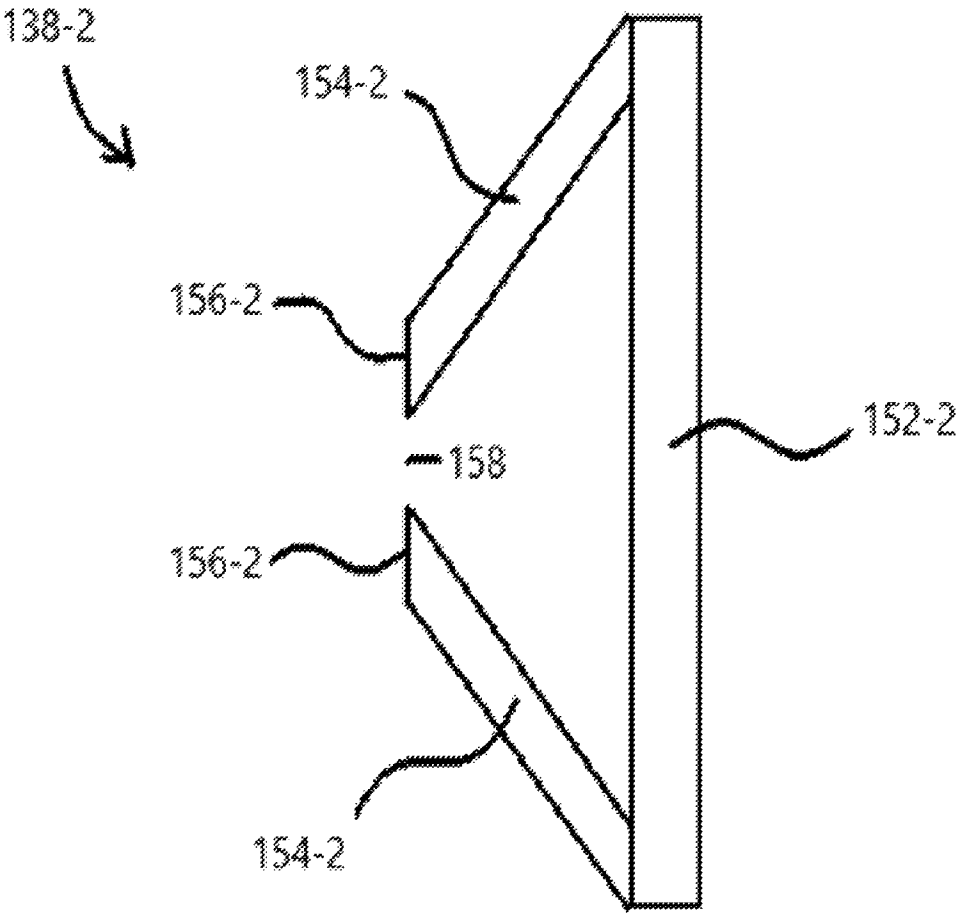
FIG. 29 is a demonstrative view of an arrangement of a connection member formed of a folded piece of rectangular metallic material having a flattened area at the inward most edge of the ends of end walls that engage the interior surface of the drapery rod.

In the embodiment of FIG. 28, the leading point, at the outward ends 156 of end walls 154 helps to cut into the interior surface 152 of hollow interior 48 thereby helping to hold drive coupler 42 in place within the hollow interior 48 of drapery rod 26. This arrangement, also allows the ends 156 of end walls 154 to slide over and capture interior feature 54 within slot 158, when the pressure applied by ends 156 of end walls 154 allows for such movement. In the embodiment of FIG. 29 the outward ends 156-2, having a flat or arcuate shape, may provide the same function as the outwards ends 156 illustrated in FIG. 28, except that the outwards ends 156-2 of FIG. 29 may contact the interior feature 54 at a location nearer the interior surface 152 than does the outwards ends 156 of the connection member 138 of FIG. 28. This may allow for a better capture of the interior feature 54 by the outward ends 156-2 of the connection member 138-2 of FIG. 29. In fact, the outwards ends 156-2 of FIG. 29 may also make it easier for the interior feature 54 to pass into the slot 158 than allowed for by the outwards ends 156 of FIG. 28.

It is worth noting that performance characteristics of the drive coupler 42 may vary or may be modified by modifying the amount of pressure applied by the drive coupler 42 on the interior surface 52 of hollow interior 48 of drapery rod 46. That is, when it is desired that the ends 156 of end walls 154 of connection members 138 are to cut into the interior surface 52 of drapery rod 26, a high amount of pressure is to be applied by drive coupler 42 onto drapery rod 26. In contrast, when it is desired that the ends 156 of end walls 154 of connection members 138 are to slide over the interior surface 52 of drapery rod 26 and capture the interior feature 54 into slot 158, less pressure is to be applied by drive coupler 42 onto drapery rod 26. This pressure and these functional characteristics may be modified by adjusting the dimensions of drive coupler 42, that is the diameter of drive coupler and/or the effective diameter of the ends 156 of end wall 154, as well as the durometer of the material of the main body 136 of drive coupler 42, which may be made harder or softer (more rigid or more malleable) depending on the desired functionality.

The connection members 138 may also be configured in different manners to facilitate different functionality. In one arrangement, the number of connection members 138 may vary, from one, to two, to three, to four, to five, or more. In addition, the number of points of contact of each connection member 138 may be varied.

In the arrangement shown, in FIGS. 1-28, each connection member connects at two points to the interior surface 52 of hollow interior 48 of drapery rod 26. In one arrangement, the number of connection points for each of the connection members 138 may vary, from one, to two, to three, to four, to five, or more.

In addition, the shape of ends 156 of the one or more end walls 154 may vary to vary the ways the ends 156 connect to the interior surface 52 of hollow interior 48 of drapery rod 26. IN one arrangement, the end or ends 156 of connection members 138 may be sharpened to a point, to help cut into the interior surface 52 of hollow interior 48. In another arrangement, the end or ends 156 of connection members 138 may be serrated or saw toothed, again, to help cut into the interior surface 52 of hollow interior 48. In an alternative arrangement, the end or ends of connection members 138 may be squared or rounded to help prevent the connection members 138 from cutting into the interior surface 52 of hollow interior 48. Any other configuration is hereby contemplated for use.

Alternative Arrangement—Captured Connection Members:

In the arrangement shown in FIGS. 7-14 and 16-18, as one example, the recesses 146 of main body 136 connect to the outward end 148 and the inward end 150 of main body 136. This configuration allows the generally triangularly shaped connection members 138 to be slid in to recesses 146 from an end 138, 150. This eases that assembly of connection members 138 into main body 136 of drive coupler 42, which is good. However, under certain circumstances, having recesses 146 connect to the outward end 148 and/or the inward end 150 of main body 136 allows connection members 138 to unintentionally slide out of recesses 146 during installation and/or removal of drive coupler 42 from the hollow interior 48 of drapery rod 26.

This unintentional sliding out of connection members 138 from recesses 146 can be corrected by screwing, bolting, stapling, adhering or otherwise affixing or attaching connection members 138 to main body 136 of drive coupler 42. However, doing so requires an additional manufacturing step. In addition, each of these methods of attaching connection member 138 to drive coupler 42 can fail overtime With reference to FIGS. 19-27 an alternative arrangement of a drive coupler 42 is presented that helps to prevent the unintentional dislodgement of connection members 138 from main body 136 of drive coupler 42. In this arrangement, recesses 146 are positioned within main body 136 of drive coupler 42 and recesses 146 terminate within the material of main body 136. Or, said another way, recesses 146 do not connect to the inward end 150 or the outward end 149 of main body 136. As such, a layer of material is positioned between the outward end of recesses 146 and the outward end 148 of main body 136, and a layer of material is positioned between the inward end of recesses 146 and the inward end 150 of main body 136.

In this arrangement, when pressure is applied to drive coupler 42 during an insertion or removal process, if connection members 138 slide within the recesses 146 they engage the layer of material between the end of recesses 146 and the end 148, 150 of main body 136. This engagement stops connection member 138 from unintentionally sliding out of recess 146.

Capturing the ends of connection members 138 by a layer of material of main body 136 may make the installation of connection members 138 more difficult. As such, in one arrangement, connection members 138 are molded into the material of main body 136, in much the same way drive lug 140 may be molded into the material of main body 136 of drive coupler 42. In an alternative arrangement, due to the malleability of the material of main body 136 of drive coupler, despite the captured nature of connection members 138 within recesses 146, connection members 138 may be forced into recesses 146 by deforming the material of main body 136 and forcing each connection member 138 into a recess 146. Once inserted, the material of main body 136 moves back to its pre-distorted position thereby dimensionally capturing connection member 138 within the shape of recess 146. In one arrangement, to help ensure connection members 138 do not come out of recesses 146, an adhesive or other connecting means or method is used to bind connection members 138 to recesses 146

Alternative Arrangement—Smooth Hollow Interior—Cutting into Interior Surface:

In one arrangement, drapery rod 26 has a smooth interior surface 52 that is void of any interior features 54. In this arrangement, the ends 156 of connection members 138 cut into the interior surface 52 of hollow interior 48 of drapery rod 26 thereby providing the hold between drive coupler 42 and the interior surface 52 of drapery rod 26.

In one arrangement, one, two, three, four, or five or more connection members 138, each having a one, two, three or more end walls 154 with an end 156 extend out of the exterior surface 142 of main body 136 of drive coupler 42 and engage the interior surface 52. In one arrangement, these ends 156 engage the interior surface 52 in a generally perpendicular manner to the interior surface 52. In an alternative arrangement ends 156 engage the interior surface 52 at an angle, other than perpendicular. In one arrangement, when connection members 138 have two end walls 154, the outer walls extend toward one another, such as that shown in FIGS. 1-28; whereas in an alternative arrangement when connection members 138 have two end walls 154, the outer walls extend away from one another.

In one arrangement, the ends 156 of end walls 154 are sharp and pointed, like the edge of a razor or knife, and are intended to cut into the interior surface 52. In one arrangement, the ends 156 of end walls 154 are sharp and squared and are intended to cut into the interior surface 52. In these arrangements, the ends 156 of end walls 154 cut into the interior surface 52 of drapery rod 26 upon insertion of drive coupler 42 thereby forming their own features in the interior surface 52 of drapery rod 26 and thereby forming a secure connection to the featureless interior surface 52 of drapery rod 26 that facilitates the rotation of drapery rod 26.

In one arrangement, the ends 156 of end walls 154 are rounded and/or squared and/or not-sharp and/or are not-intended to cut into the interior surface 52, or it is not needed for them to cut into the interior surface 52 of drapery rod 26 to facilitate a robust connection to drapery rod 26. Instead of cutting into the drapery rod 26, in this arrangement the drive coupler 42 uses pressure and/or friction to affix itself to the interior surface 52 of the drapery rod 26. In one arrangement, the combination of the angle of the ends 156 of connection members 138 coupled with the shape of the ends 156 of connection members 138 coupled with the angle the ends 156 of connection members 138 engage the interior surface 52 of drapery rod 26 coupled with the number of connection members 138 that engage the interior surface 52 of drapery rod 26 coupled with the amount of pressure that the ends 156 of connection members 138 apply to the interior surface 52 of drapery rod 26 facilitate a robust frictional and locking connection. In one arrangement the angle of the connection members 138 engage the interior surface 52 of drapery rod 26 at an angle or a slight angle in the direction of rotation. This angle helps the connection members 138 lean-into or bite-into the interior surface 52 of drapery rod 26 during rotation which helps transfer torque and rotation without slippage. In this arrangement, wherein the connection members 138 include two ends 156, one angled in each direction, this helps bite into the interior surface 52 of drapery rod 26 and prevent slippage in both directions of rotation, clockwise and counter clockwise. Any other configuration is hereby contemplated for use.

Ambivalence Regarding Feature on Interior Surface of Drapery Rod:

In one arrangement, as is presented herein, drive coupler 42 engages one or more features 54 on the interior surface 52 of drapery rod 26. This engagement between drive coupler 42 and feature 54 may be pre-aligned, meaning that the drive coupler 42 is inserted into the hollow interior 48 of drapery rod 26 with the feature 54 positioned within the slot 158 of a connection member 138. Alternatively, this engagement between drive coupler 42 and feature 54 may be non-aligned upon insertion of the drive coupler 42 is into the hollow interior 48 of drapery rod 26 and once the motor 76 is powered the feature 54 is captured within the slot 158 of a connection member 138.

In another arrangement, as is presented herein, drive coupler 42 does not need to engage feature 54 on the interior surface 52 of drapery rod 26, and instead in this arrangement the drive coupler 42 and connection members 138 are dimensioned such that they facilitate connection to drapery rod 26 without the need to capture feature 54 within slot 158 of a connection member 138. As such, in this arrangement, drive coupler 42 and the connection method presented herein is ambivalent whether one or more features 54 are present in the interior surface 52 of drapery rod 26. That is, the same drive coupler 42 and connection methodology may be used with drapery rods 26 having a feature-free or entirely smooth interior surface 52 as well as with drapery rods 26 that include one or more features 54 on the interior surface 52.

As such, this arrangement allows for use of welded drapery rods 26 that include one or more features 54 as well as feature-free tubes that may be extruded, machined, reamed or manufactured by any other method or means.

Smooth and Undulating Interior Surfaces of Drapery Rod:

To be clear, the arrangement presented herein, with the use of drive coupler 42 that include connections members 138 having end walls 154 with ends 156 that engage the interior surface 52 of drapery rod 26, applies when the interior surface 52 is smooth as well as when the interior surface 52 is undulating or has impressions in it from forming the guide structure 50 in the exterior surface 46 of drapery rod 26.

That is, in one arrangement, when drapery rod 26 has machined features which form guide structure 50 in the exterior surface 46 of drapery rod 26, the interior surface 52 of drapery rod 26 is generally smooth, straight and constant from end to end of drapery rod 26. This is often referred to as a machined drapery rod 26. Due to the machining process that forms the guide structure 50 in the exterior surface 46 of the drapery rod 26, the interior surface 52 of drapery rod 26 is unaffected by the formation of the guide structure 50. As such, the interior surface 52 of drapery rod 26 remains generally smooth, straight and constant from end to end of drapery rod 26 (regardless of whether it includes one or more features 54 therein).

In another arrangement, when drapery rod 26 has formed features which form guide structure 50 in the exterior surface 46 of drapery rod 26, the smooth interior surface 52 of drapery rod 26 includes impressions, or an undulating surface, which is formed by the forming of the guide structure 50 in the exterior surface 46 of drapery rod 26. Due to the forming process that forms the guide structure 50 in the exterior surface 46 of the drapery rod 26, the interior surface 52 of drapery rod 26 is pressed inward by the formation of the guide structure 50. As such, the interior surface 52 of drapery rod 26 includes impressions or undulations in the interior surface 54 where the guide structure 50 is present in the exterior surface 46. As such, in this arrangement, the interior surface 52 of drapery rod 26 remains generally smooth with the undulations of the impressions of the guide structure 50 extending from end to end of drapery rod 26 (regardless of whether it includes one or more features 54 therein).

Drive coupler 42, as is presented herein, is capable of facilitating connecting to the interior surface 52 of drapery rod 26 regardless of whether the interior surface 52 of drapery rod 26 is smooth and straight or smooth and includes impressions due to forming of guide structure 50 therein. In one arrangement, to ensure secure connection to the undulating smooth interior surface 52 of drapery rod 26 connection members 138 are long enough to ensure connection to at least two undulations in the interior surface 52 of drapery rod 26. This ensures a secure connection that is stable as each connection member 138 connects at multiple points to the interior surface 52 of drapery rod 26 thereby providing a strong, stable and secure connection. Also by providing elongated connection members 138 this ensures smooth sliding insertion of drive coupler 42 into hollow interior 48 as well as a secure connection that is robust and unlikely to break free during rotation.

From the above discussion it will be appreciated that the drapery rod system 10 and related methods of use, presented herein improves upon the state of the art.

Specifically, the drapery rod system 10 and related methods of use presented: that improves upon the state of the art; reduces cost over existing arrangements; facilitates the use of thin walled tubes; allows for the use of formed tubes, instead of machined tubes; that facilitates connection to formed tubes; that facilitates use of less expensive; that reduces the complexity of the manufacturing process; that reduces the amount of time required to manufacture; that reduces the amount of machine time required to manufacture the product; that eliminates the need for a machined tube; that is easy to assemble; that has a relatively foolproof design; that reduces the transmission of vibrations; that dampens vibrations; that provides some give to the system; that is easy to use; that is simple in design; that facilitates quiet operation; that facilitates smooth operation; that is relatively inexpensive or affordable; that has a minimum number of parts; that can be used with any shade material; that facilitates robust operation; among countless other advantages and improvements.

It will be appreciated by those skilled in the art that other various modifications could be made to the device without parting from the spirit and scope of this disclosure. All such modifications and changes fall within the scope of the claims and are intended to be covered thereby.

What is claimed:

1. A drapery system comprising:

a drapery rod;

the drapery rod extending a length from a first end to a second end;

the drapery rod operatively connected to a structure by a first bracket and a second bracket;

the drapery rod having an exterior surface;

wherein the exterior surface of the drapery rod is generally cylindrical in shape;

the exterior surface of the drapery rod having a guide structure;

wherein the guide structure is configured to move shade material along the length of the drapery rod between an open position and a closed position when rotated;

the drapery rod having an interior surface that forms a hollow interior;

the interior surface of the drapery rod having a plurality of helical impressions that protrude inward into the hollow interior of the drapery rod;

a drive coupler;

the drive coupler having a main body formed of a compressible non-metallic material;

the drive coupler having at least one connection member formed of a metallic material;

a motor;

the motor operatively connected to the drive coupler;

wherein when the drive coupler is inserted within the hollow interior of the drapery rod, the at least one connection member of the drive coupler bites and holds onto at least one of the plurality of helical impressions of the interior surface.

2. The drapery system of claim 1, wherein the at least one connection member includes a pair of opposing arms that angle toward one another and include a space between their ends.

3. The drapery system of claim 1, wherein the drapery rod is a thin-walled formed tube.

4. The drapery system of claim 1, wherein the guide structure of the drapery rod is formed into the drapery rod using a process other than machining.

5. The drapery system of claim 1, wherein the motor is configured to be inserted into the hollow interior of the drapery rod.

6. The drapery system of claim 1, wherein the motor is powered by an external power source.

7. The drapery system of claim 1, wherein the helical impressions of the hollow interior are created by the guide structure being formed into the drapery rod.

8. The drapery system of claim 1, wherein the exterior surface of the drapery rod has a plurality of lobes; wherein the guide structure is formed at meeting points of lobes.

9. The drapery system of claim 1, wherein the drive coupler is configured to be completely inserted within the hollow interior of the drapery rod.

10. The drapery system of claim 1, wherein the connection members engage non-linear features positioned within the hollow interior of the drapery rod.

11. The drapery system of claim 1, wherein the connection members are positioned adjacent an inward end of the motor.

12. A drapery system comprising:

a drapery rod;

the drapery rod extending a length from a first end to a second end;

the drapery rod operatively connected to a structure by a first bracket and a second bracket;

the drapery rod having an exterior surface;

wherein the exterior surface of the drapery rod is generally cylindrical in shape;

the exterior surface of the drapery rod having a guide structure;

wherein the guide structure is configured to move shade material along the length of the drapery rod between an open position and a closed position when rotated;

the drapery rod having an interior surface that forms a hollow interior;

the interior surface of the drapery rod having a plurality of helical impressions that protrude inward into the hollow interior of the drapery rod;

wherein the drapery rod is a thin walled formed tube;

a drive coupler;

the drive coupler having at least one connection member;

a motor;

the motor operatively connected to the drive coupler;

wherein when the drive coupler is inserted within the hollow interior of the drapery rod, the at least one connection member of the drive coupler bites and holds onto at least one of the plurality of helical impressions of the interior surface wherein the drive coupler includes a main body, and wherein the main body is formed of a compressible non-metallic material.

13. The drapery system of claim 12, wherein the at least one connection member is formed of a metallic material.

14. The drapery system of claim 12, wherein the at least one connection member includes a pair of opposing arms that angle toward one another and include a space between their ends.

15. The drapery system of claim 12, wherein the guide structure of the drapery rod is formed into the drapery rod using a process other than machining.

16. The drapery system of claim 12, wherein the motor is configured to be inserted into the hollow interior of the drapery rod.

17. The drapery system of claim 12, wherein the motor is powered by an external power source.

18. The drapery system of claim 12, wherein the helical impressions of the interior surface are created by the guide structure being formed into the drapery rod.

19. The drapery system of claim 12, wherein the exterior surface of the drapery rod has a plurality of lobes; wherein the guide structure is formed at meeting points of lobes.

20. The drapery system of claim 12, wherein the drive coupler is configured to be completely inserted within the hollow interior of the drapery rod.

21. The drapery system of claim 12, wherein the connection members engage non-linear features positioned within the hollow interior of the drapery rod.

22. The drapery system of claim 12, wherein the connection members are positioned adjacent an inward end of the motor.

23. A drapery system comprising:

a drapery rod;

the drapery rod extending a length from a first end to a second end;

the drapery rod operatively connected to a structure by a first bracket and a second bracket;

the drapery rod having an exterior surface;

wherein the exterior surface of the drapery rod is generally cylindrical in shape;

the exterior surface of the drapery rod having a guide structure;

wherein the guide structure is configured to move shade material along the length of the drapery rod between an open position and a closed position when rotated;

the drapery rod having an interior surface that forms a hollow interior;

the interior surface of the drapery rod having a plurality of helical impressions that protrude inward into the hollow interior of the drapery rod;

the plurality of helical impressions having an inward most edge;

a drive coupler; the drive coupler formed of a compressible non-metallic material; the drive coupler having a plurality of connection members;

a motor;

the motor operatively coupled to the drive coupler;

wherein the drive coupler is configured to be inserted within the hollow interior of the drapery rod and the plurality of connection members are configured to bite and hold onto the inward most edge of at least one of the plurality of helical impressions of the interior surface;

wherein when the motor operates the drive coupler rotates;

wherein rotation of the drive coupler causes rotation of the drapery rod.

24. The drapery system of claim 23, wherein the helical impressions of the hollow interior are created by the guide structure being formed into the drapery rod.

25. The drapery system of claim 23, wherein the exterior surface of the drapery rod has a plurality of lobes; wherein the guide structure is formed at meeting points of lobes.

26. The drapery system of claim 23, wherein the drive coupler is configured to be completely inserted within the hollow interior of the drapery rod.

27. The drapery system of claim 23, wherein the connection members engage non-linear features positioned within the hollow interior of the drapery rod.

28. The drapery system of claim 23, wherein the connection members are positioned adjacent an inward end of the motor.

29. A drapery system comprising:

a drapery rod;

the drapery rod extending a length from a first end to a second end;

the drapery rod operatively connected to a structure by a first bracket and a second bracket;

the drapery rod having an exterior surface;

wherein the exterior surface of the drapery rod is generally cylindrical in shape;

the exterior surface of the drapery rod having a guide structure;

wherein the guide structure is configured to move shade material along the length of the drapery rod between an open position and a closed position when rotated;

the drapery rod having an interior surface that forms a hollow interior;

the interior surface of the drapery rod having a plurality of helical impressions that protrude inward into the hollow interior of the drapery rod;

the plurality of helical impressions having an inward most edge;

a drive coupler;

the drive coupler having a main body formed of compressible non-metallic material;

the drive coupler having a plurality of connection members formed of metallic material;

a motor;

the motor operatively coupled to the drive coupler;

wherein when the drive coupler is inserted within the hollow interior of the drapery rod the main body compresses and the plurality of connection members bite and hold onto the inward most edge of at least one of the plurality of helical impressions;

wherein when the motor operates the drive coupler rotates;

wherein rotation of the drive coupler causes rotation of the drapery rod.

30. The drapery system of claim 29, wherein the plurality of connection members cut into and hold onto the inwardmost edge of at least two of the plurality of helical impressions.

31. A drapery system comprising:

a hollow drapery rod having an interior surface with a plurality of helical impressions protruding inward into a hollow interior of the drapery rod;

a drive coupler having a main body formed of a compressible non-metallic material and a plurality of connection members, wherein the plurality of connection members extend across at least one of the helical impressions of the plurality of helical impressions and bite into the at least one of the helical impressions.

* * * * *